US009758941B2

(12) United States Patent
Finn, III et al.

(10) Patent No.: US 9,758,941 B2
(45) Date of Patent: Sep. 12, 2017

(54) OFFSHORE TOWER FOR DRILLING AND/OR PRODUCTION

(75) Inventors: Lyle David Finn, III, Sugar Land, TX (US); Edward E. Horton, III, Houston, TX (US); James V. Maher, Houston, TX (US)

(73) Assignee: HORTON WISON DEEPWATER, INC., Houston, TX (US)

( * ) Notice: Subject to any disclaimer, the term of this patent is extended or adjusted under 35 U.S.C. 154(b) by 856 days.

(21) Appl. No.: 13/275,648

(22) Filed: Oct. 18, 2011

(65) Prior Publication Data

US 2012/0093587 A1 Apr. 19, 2012

Related U.S. Application Data

(60) Provisional application No. 61/394,646, filed on Oct. 19, 2010.

(51) Int. Cl.
*B63B 21/50* (2006.01)
*E02B 17/02* (2006.01)
(Continued)

(52) U.S. Cl.
CPC ..... *E02B 17/027* (2013.01); *B63B 21/50* (2013.01); *B63B 35/4406* (2013.01); *B63B 21/27* (2013.01);
(Continued)

(58) Field of Classification Search
USPC ..... 405/195.1, 224, 107–209, 224.1; 114/264, 265, 125, 296
See application file for complete search history.

(56) References Cited

U.S. PATENT DOCUMENTS 3,191,388 A * 6/1965 Ludwig ..... 405/197
3,256,537 A * 6/1966 Clark ..... 441/26
(Continued)

FOREIGN PATENT DOCUMENTS

WO 2004110855 A2 12/2004

OTHER PUBLICATIONS

Peruvian Technical Report dated Dec. 18, 2015, for Peruvian Application No. 001889-2011/DIN (8 p.).
(Continued)

*Primary Examiner* — Amber Anderson
*Assistant Examiner* — Patrick Lambe
(74) *Attorney, Agent, or Firm* — Conley Rose, P.C.

(57) ABSTRACT

An offshore structure comprises a hull having a longitudinal axis, a first end, and a second end opposite the first end. In addition, the structure comprises an anchor coupled to the lower end of the hull and configured to secure the hull to the sea floor. The anchor has an aspect ratio less than 3:1. The hull includes a variable ballast chamber positioned axially between the first end and the second end of the hull and a first buoyant chamber positioned between the variable ballast chamber and the first end of the hull. The first buoyant chamber is filled with a gas and sealed from the surrounding environment. Further, the structure comprises a ballast control conduit in fluid communication with the variable ballast chamber and configured to supply a gas to the variable ballast chamber. The structure also comprises a topside mounted to the first end of the hull.

28 Claims, 17 Drawing Sheets

(51) Int. Cl.

| | |
|---|---|
| ***B63B 35/44*** | (2006.01) |
| *B63B 21/27* | (2006.01) |
| *B63B 35/00* | (2006.01) |
| *E02B 17/00* | (2006.01) |

(52) U.S. Cl.
CPC ..... *B63B 35/003* (2013.01); *B63B 2021/505* (2013.01); *E02B 2017/0039* (2013.01); *E02B 2017/0047* (2013.01)

(56) References Cited

U.S. PATENT DOCUMENTS

| | | | | | |
|---|---|---|---|---|---|
| 3,408,821 | A * | 11/1968 | Redshaw | 405/200 |
| 3,474,749 | A * | 10/1969 | Robert | 114/264 |
| 3,720,066 | A * | 3/1973 | Vilain | 405/202 |
| 3,783,815 | A * | 1/1974 | Towne et al. | 114/303 |
| 4,165,196 | A * | 8/1979 | Serrano | 405/205 |
| 4,168,673 | A * | 9/1979 | Poeppel | 114/265 |
| 4,656,962 | A * | 4/1987 | Hale | 114/264 |
| 4,913,238 | A | 4/1990 | Danazcko et al. | |
| 5,403,124 | A * | 4/1995 | Kocaman et al. | 405/209 |
| 5,983,822 | A * | 11/1999 | Chow et al. | 114/264 |
| 6,132,145 | A * | 10/2000 | Treu et al. | 405/224 |
| 6,135,673 | A * | 10/2000 | Horton et al. | 405/205 |
| 6,206,614 | B1 * | 3/2001 | Blevins et al. | 405/224 |
| 6,273,018 | B1 * | 8/2001 | Gottsche et al. | 114/264 |
| 6,309,141 | B1 * | 10/2001 | Cox et al. | 405/224 |
| 6,347,909 | B1 * | 2/2002 | Kocaman | 405/209 |
| 6,457,908 | B1 * | 10/2002 | Bergeron | 405/224 |
| 6,471,444 | B1 * | 10/2002 | Pollack | 405/203 |
| 6,488,447 | B1 * | 12/2002 | Nish et al. | 405/224.2 |
| 6,565,286 | B2 * | 5/2003 | Carr et al. | 405/204 |
| 8,231,308 | B2 * | 7/2012 | Alliot | 405/224.2 |
| 2001/0036387 | A1 * | 11/2001 | Richter et al. | 405/195.1 |
| 2004/0240947 | A1 * | 12/2004 | Wetch | 405/224.2 |
| 2005/0158125 | A1 * | 7/2005 | Thomas et al. | 405/203 |

OTHER PUBLICATIONS

English Summary of Peruvian Technical Report dated Dec. 18, 2015, for Peruvian Application No. 001889-2011/DIN (8 p.).
Malaysian Examination Report dated May 13, 2016, for Application No. PI 2013001399 (3 p.).
Mexican Office Action dated Apr. 14, 2015, for Mexican Application No. MX/a/2013/004327 (3 p.).
Chinese Office Action dated Mar. 25, 2013; Chinese Application No. 201180061200.2 (12 p.).
Chinese Office Action dated Feb. 16, 2016, for Chinese Application No. 201180061200.2 (7 p.).
English Translation of Chinese Office Action dated Feb. 16, 2016, for Chinese Application No. 201180061200.2 (9 p.).
Mexican Office Action dated Dec. 10, 2015, for Mexican Application No. MX/a/2013/004327 (4 p.).
English Translation of Mexican Office Action dated Dec. 10, 2015, for Mexican Application No. MX/a/2013/004327 (4 p.).
Chinese Office Action dated Sep. 1, 2016, for Chiense Application No. 201180061200.2 (9 p.).
English summary of Chinese Office Action dated Sep. 1, 2016, for Chinese Application No. 201180061200.2 (1 p.).
Lu, Xiaobing, et al., "Progress in the Study on the Bucket Foundations of Offshore Platform," Advances in Mechanics, vol. 33, No. 1, Feb. 25, 2003, pp. 27-40 (14 p.).
English translation of relevant portions of Lu, Xiaobing, et al., "Progress in the Study on the Bucket Foundations of Offshore Platform," Advances in Mechanics, vol. 33, No. 1, Feb. 25, 2003, pp. 27-40 (9 p.).
Tingjian, Zhang, et al., "Study Scheme of Simulation Experiment on Suction Technique for Offshore Bucket Foundations," Mar. 1999 pp. 68-78 (12 p.).
English translation of relevant portions of Tingjian, Zhang, et al., "Study Scheme of Simulation Experiment on Suction Technique for Offshore Bucket Foundations," Mar. 1999 pp. 68-78 (6 p.).
PCT/US2011/056654 International Search Report and Written Opinion dated Apr. 12, 2012 (14 p.).

* cited by examiner

OFFSHORE TOWER FOR DRILLING AND/OR PRODUCTION

CROSS-REFERENCE TO RELATED APPLICATIONS

This application claims benefit of U.S. provisional patent application Ser. No. 61/394,646 filed Oct. 19, 2010, and entitled "Buoyant Tower," which is hereby incorporated herein by reference in its entirety.

STATEMENT REGARDING FEDERALLY SPONSORED RESEARCH OR DEVELOPMENT

Not applicable.

BACKGROUND

Field of the Invention

The invention relates generally to offshore structures to facilitate offshore oil and gas drilling and production operations. More particularly, the invention relates to compliant offshore towers releasably secured to the sea floor.

Background of the Technology

Various types of offshore structures may be employed to drill and/or produce subsea oil and gas wells. Usually, the type of offshore structure selected for a particular application will depend on the depth of water at the well location. For water depths up to about 600 ft., fixed platforms are often employed. Fixed platforms include a concrete and/or steel jacket anchored directly to the sea floor, and a deck positioned above the sea surface and mounted to the upper end of the jacket.

Fabrication and installation of a fixed platform requires a particular infrastructure and skilled labor. For example, launch barges are needed to transport the components of the jacket and the deck to the offshore installation site, derrick barges are needed to position and lift the upper portion of the jacket, and derrick barges are needed to lift and position the deck atop the jacket. In addition, installation of a fixed platform often requires the installation of piles that are driven into the seabed to anchor the jacket thereto. In deeper applications, additional skirt piles must also be driven into the seabed. In select geographic locations such as the Gulf of Mexico, fixed jacket platforms are fabricated, deployed, and installed on a regular basis. Accordingly, such regions typically have the experience, infrastructure, and skilled labor to enable fixed jacket platforms to provide a viable, competitive option for offshore drilling and/or production. In other regions, having little to no experience with fixed jacket platforms, the facilities, equipment, infrastructure, and labor may be insufficient to efficiently construct, deploy, and install a fixed jacket platform. Moreover, even in some regions, such as Brazil and Peru, that have some experience fabricating and installing fixed jacket platforms, the range of applications for fixed jacket platforms anticipated in the next few years may exceed present capabilities.

Fixed jacket platform are typically designed to have a natural period that is less than any appreciable, wave energy anticipated at the offshore installation site. This is relatively easy to accomplish in shallow waters. However, as water depths increase, the inherent compliance, and hence natural period, of the jacket increases. To reduce the natural period of the jacket below the anticipated wave energy as water depth increases, the jacket is stiffened by increasing the size and strength of the jacket legs and pilings. Such changes may further increase the infrastructure and labor requirements for fabrication and installation of the jacket.

Compliant towers offer another alternative for offshore applications with water depths up to about 600 ft. Compliant towers include a truss structure anchored directly to the sea floor, and a deck positioned above the sea surface and mounted to the upper end of the truss structure. Although the lower end of the truss structure is rigidly secured to the sea floor, the truss structure is designed to flex over its length in response to environmental loads. However, the lower end of the truss structure is typically secured to the sea floor with piles that are driven into the sea bed, and thus, provides some of the same installation challenges as fixed jacket platforms.

Accordingly, there remains a need in the art for offshore drilling and/or production bottom-founded structures anchored to the sea floor that require less infrastructure and specialized labor to fabricate and install. Such offshore systems would be particularly well-received if they could be transported offshore and between different installation sites with relative ease.

BRIEF SUMMARY OF THE DISCLOSURE

These and other needs in the art are addressed in one embodiment by an offshore structure for drilling and/or producing a subsea well. In an embodiment, the offshore structure comprises a hull having a longitudinal axis, a first end, and a second end opposite the first end. In addition, the offshore structure comprises an anchor coupled to the lower end of the hull and configured to secure the hull to the sea floor. The anchor has an aspect ratio less than 3:1. The hull includes a variable ballast chamber positioned axially between the first end and the second end of the hull and a first buoyant chamber positioned between the variable ballast chamber and the first end of the hull. The first buoyant chamber is filled with a gas and sealed from the surrounding environment. Further, the offshore structure comprises a ballast control conduit in fluid communication with the variable ballast chamber and configured to supply a gas to the variable ballast chamber. Still further, the offshore structure comprises a topside mounted to the upper end of the hull.

These and other needs in the art are addressed in another embodiment by a method. In an embodiment, the method comprises (a) positioning a buoyant tower at an offshore installation site. The tower includes a hull, a topside mounted to a first end of the hull, and an anchor coupled to a second end of the hull. In addition, the method comprises (b) ballasting the hull. Further, the method comprises (c) penetrating the sea floor with the anchor. Still further, the method comprises (d) allowing the tower to pitch about the lower end of the hull after (c).

These and other needs in the art are addressed in another embodiment by an offshore structure for drilling and/or producing a subsea well. In an embodiment, the offshore structure comprises a net buoyant hull including a plurality of columns. Each column has a longitudinal axis, a first end, and a second end opposite the first end. Each column includes a variable ballast chamber positioned axially between the first end and the second end of the column and a first buoyant chamber positioned axially between the variable ballast chamber and the first end of the column. The first buoyant chamber of each column is filled with a gas and sealed from the surrounding environment. In addition, the offshore structure comprises a plurality of first conduits. One of the first conduits is in fluid communication with each variable ballast chamber and is configured to supply a gas to the corresponding variable ballast chamber and vent the gas from the corresponding variable ballast chamber. Further, the offshore structure comprises an anchor coupled to the second ends of the columns. The anchor is configured to secure the hull to the sea floor. Moreover, the offshore structure comprises a topside mounted to the hull.

Embodiments described herein comprise a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE PREFERRED EMBODIMENTS

Figure 1:
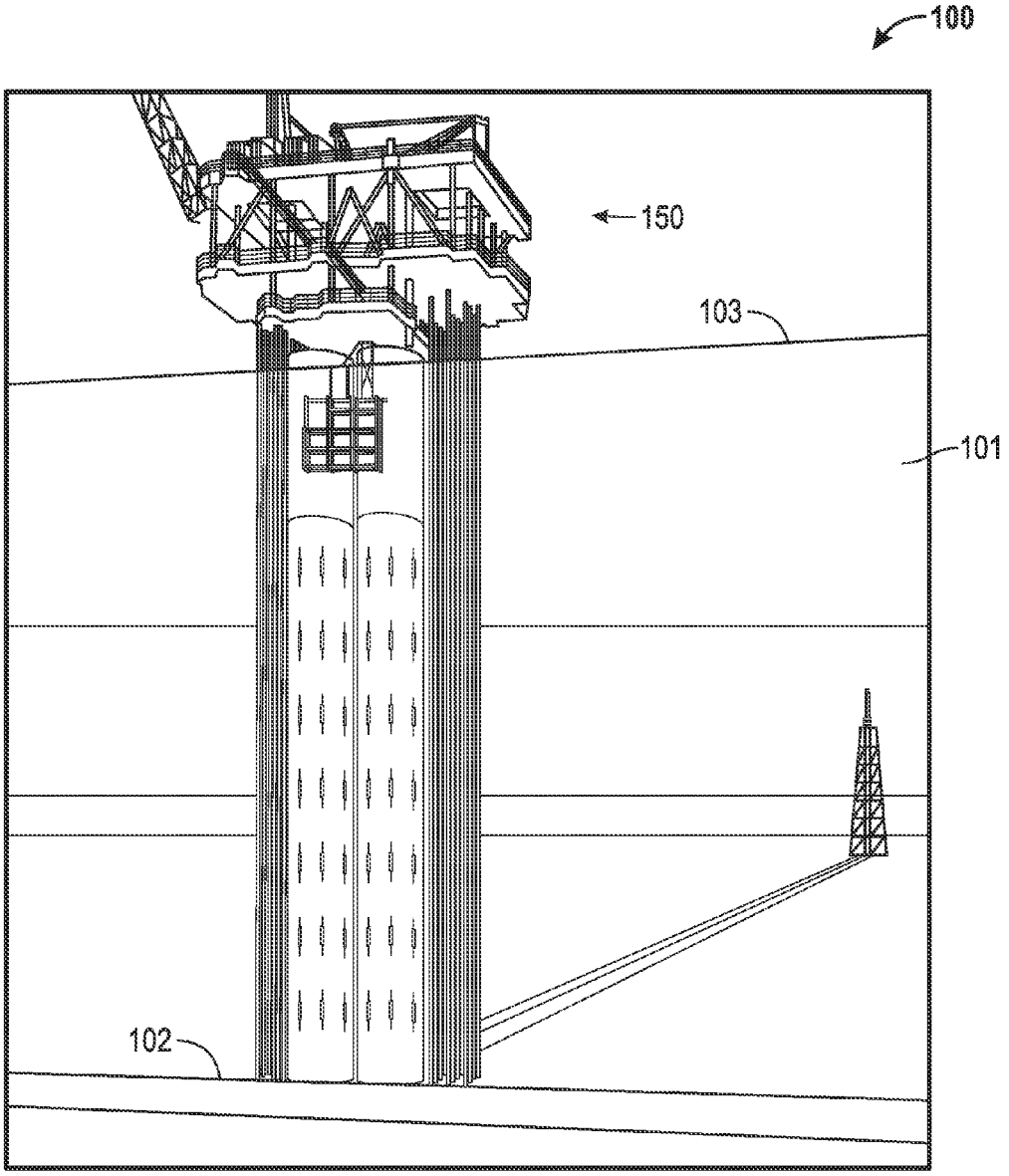
FIG. 1 is a perspective view of an embodiment of an offshore tower in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

Figure 2:
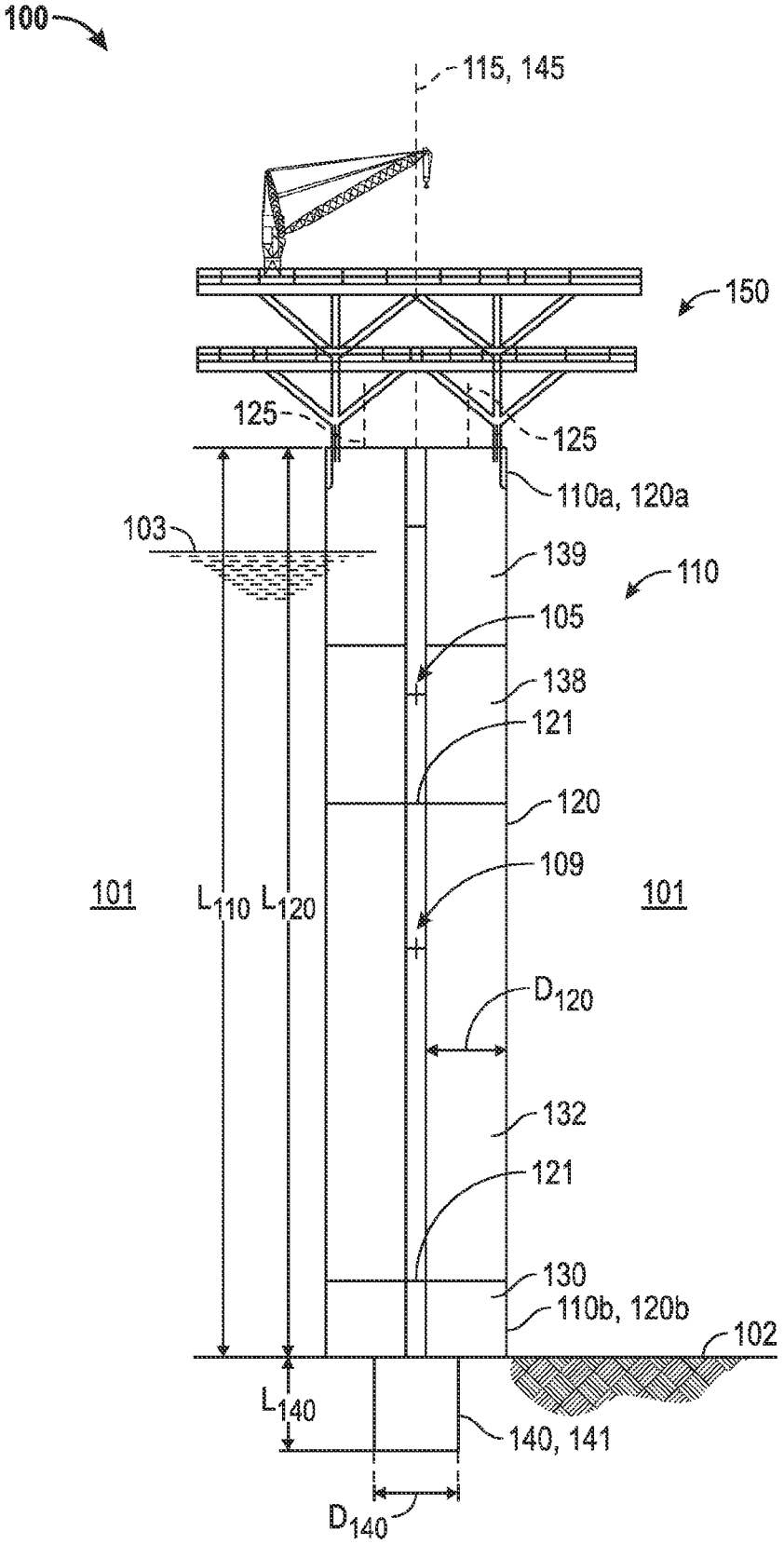
FIG. 2 is a front view of the tower of FIG. 1.

Referring now to FIGS. 1 and 2, an embodiment of an offshore tower 100 in accordance with the principles disclosed herein is shown. Tower 100 is shown deployed in a body of water 101 and releasably coupled to the sea floor 102 at an offshore site. Consequently, tower 100 may be referred to as a bottom-founded structure, it being understood that bottom-founded offshore structures are anchored directly to the sea floor and do not rely on mooring systems to maintain their position at the installation site. In general, tower 100 may be deployed offshore to drill a subsea wellbore and/or produce hydrocarbons from a subsea wellbore. In this embodiment, tower 100 includes an elongate hull 110 and a topside or deck 150 mounted to hull 110 above the sea surface 103.

Hull 110 has a central or longitudinal axis 115, a first or upper end 110*a* extending above the sea surface 103 and a second or lower end 110*b* opposite end 110*a*. Hull 110 is releasably secured to the sea floor 102 with an anchor 140 coupled to lower end 110*b*. The length $L_{110}$ of hull 110 measured axially from end 110*a* to end 110*b* is greater than the depth of the water 101 at the offshore installation site. Thus, with lower end 110*b* disposed at the sea floor 102, upper end 110*a* extends above the sea surface 103. In general, the length $L_{110}$ of hull 110 may be varied for installation in various water depths. However, embodiments of tower 100 described herein are particularly suited for deployment and installation in water depths greater than 300 ft.

As best shown in FIG. 2, hull 110 comprises a plurality of elongate parallel cylindrical columns 120. In this embodiment, hull 110 includes four columns 120 generally arranged in a square configuration, with each column 120 defining one corner of the square. Columns 120 are coupled by a plurality of shear plates 121 extending radially between each pair of adjacent columns 120.

Each column 120 has a central or longitudinal axis 125 parallel to axis 115, a first or upper end 120*a* extending above the sea surface 103, and a second or lower end 120*b* opposite end 120*a*. Upper ends 120*a* are coincident with hull upper end 110*a*, and lower ends 120*b* are coincident with hull lower ends 110*b*. Deck 150 is attached to upper end 120*a* of each column 120, and anchor 140 extends axially from lower ends 120*b* of columns 120. In this embodiment, anchor 140 is radially centered relative to columns 120 and coaxially aligned with hull 110. As will be described in more detail below, anchor 140 penetrates the sea floor 102 and secures tower 100 thereto.

Each column 120 has a length $L_{120}$ measured axially between ends 120*a, b*, and anchor 140 has a length $L_{140}$ measured axially from end 110*b* of hull 110. Length $L_{120}$ of each column 120 is equal to the length $L_{110}$ of hull 110. Further, each column 120 has a diameter $D_{120}$ measured perpendicular to its corresponding axis 125 in side view (FIG. 2), and anchor 140 has a diameter $D_{140}$ measured perpendicular to axis 115 in side view (FIG. 2). In this embodiment, each column 120 is identical, and thus, the length $L_{120}$ and diameter $D_{120}$ of each column 120 is the same.

In general, the length $L_{120}$ and the diameter $D_{120}$ of each column 120, as well as the length $L_{140}$ and diameter $D_{140}$ of anchor 140, may be tailored to the particular installation location and associated water depth. For most installation locations having water depths greater than 300 ft., the length $L_{120}$ of each column 120 is preferably about 20 to 50 ft. greater than the water depth (i.e., each column 120 preferably has a 20 to 50 foot freeboard); the length $L_{140}$ of anchor 140 is preferably about 20 to 50 ft., and more preferably about 30 ft.; and the diameter $D_{120}$, $D_{140}$ is preferably between 15 ft. and 50 ft., and more preferably about 20 to 30 ft. For an exemplary tower 100 deployed in 200 ft. of water, length $L_{120}$ of each column 120 is 230 ft., length $L_{140}$ of anchor is 30 ft., and the diameter $D_{120}$, $D_{140}$ of each column 120 and anchor 140, respectively, is 27.5 ft.

In general, the geometry of a subsea anchor or pile may be described in terms of an "aspect ratio." As used herein, the term "aspect ratio" refers to the ratio of the length of an anchor or pile measured axially along its longitudinal axis to the diameter or maximum width of the anchor or pile measured perpendicular to its longitudinal axis. Thus, anchor 140 has an aspect ratio equal to the ratio of the length $L_{140}$ of anchor 140 to the diameter $D_{140}$ of anchor 140. In embodiments described herein, the aspect ratio of anchor 140 is preferably less than 3:1, and more preferably greater than or equal to 1:1 and less than or equal to 2:1. Such preferred aspect ratios enable anchor 140 to provide a sufficient load bearing capacity and a sufficient lateral load capacity to secure tower 100 to the sea floor 102 and maintain the position of tower 100 at the installation site, while allowing tower 100 to pivot relative to the sea floor 102 as will be described in more detail below.

Figure 3:
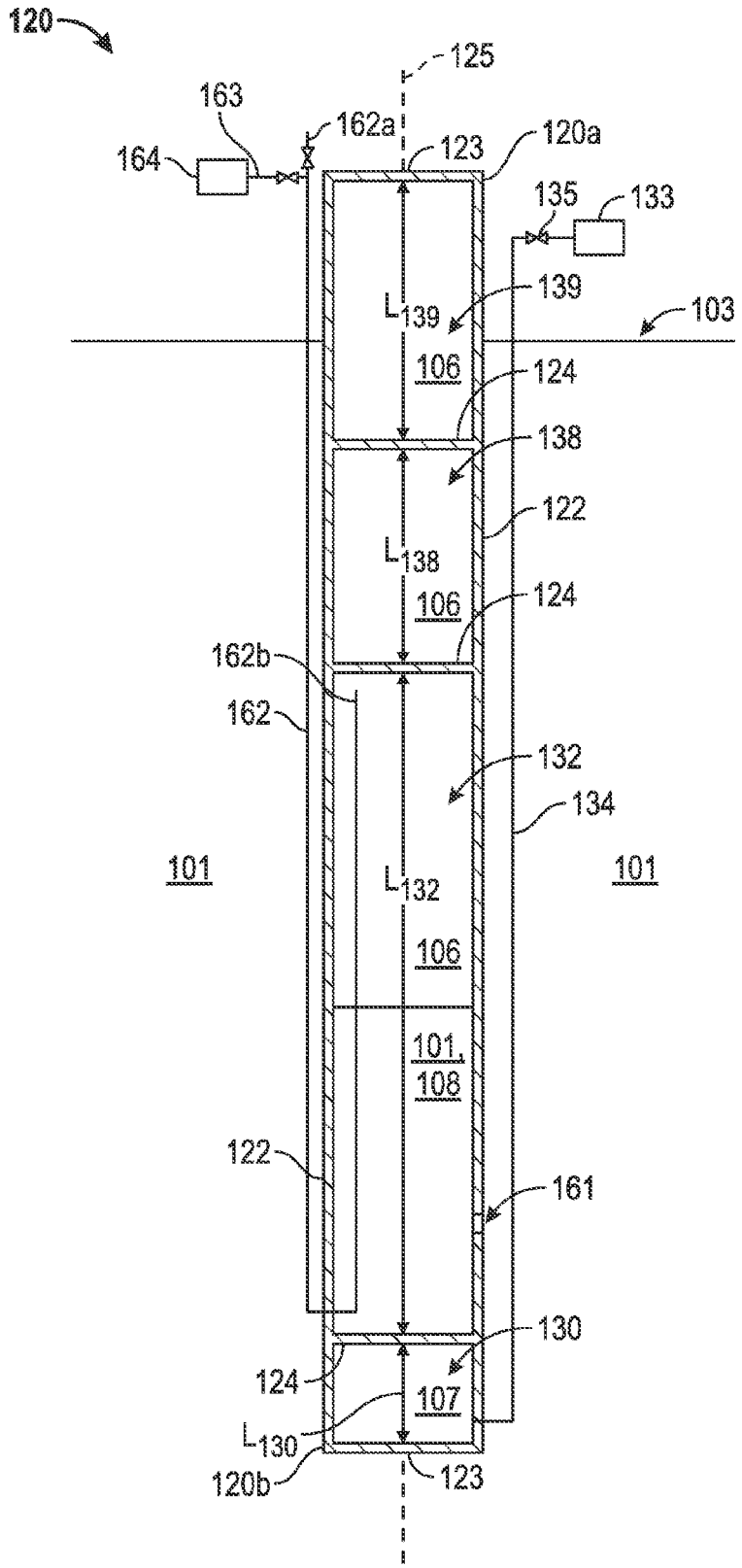
FIG. 3 is a cross-sectional view of one of the columns of FIG. 2.

Referring now to FIG. 3, one column 120 is schematically shown, it being understood that each column 120 of hull 110 is configured the same. In this embodiment, column 120 comprises a radially outer tubular 122 extending between ends 120*a, b*, upper and lower end walls or caps 123 at ends 120*a, b*, respectively, and a plurality of axially spaced bulkheads 124 positioned within tubular 122 between ends 120*a, b*. End caps 123 and bulkheads 124 are each oriented perpendicular to axis 125. Together, tubular 122, end walls 123, and bulkheads 124 define a plurality of axially stacked compartments or cells within column 120—a fixed ballast chamber 130 at lower end 120*b*, a variable ballast or ballast adjustable chamber 132 axially adjacent chamber 130, and a pair of buoyant chambers 138, 139 axially disposed between upper end 120*a* and ballast adjustable chamber 132. Each chamber 130, 132, 138, 139 has a length $L_{130}$, $L_{132}$, $L_{138}$, $L_{139}$, respectively, measured axially between its axial ends. For an exemplary tower 100 deployed in 200 ft. of water and having a column length $L_{120}$ of 230 ft., length $L_{130}$ is 20 ft., length $L_{132}$ is 120 ft., length $L_{138}$ is 40 ft., and length $L_{139}$ is 50 ft. However, depending on the particular installation location and desired dynamics for tower 100, each length $L_{130}$, $L_{132}$, $L_{138}$, $L_{139}$ may be varied and adjusted as appropriate.

End caps 123 close off ends 120*a, b* of column 120, thereby preventing fluid flow through ends 120*a, b* into chambers 130, 139, respectively. Bulkheads 124 close of the remaining ends of chambers 130, 132, 138, 139, thereby preventing fluid communication between adjacent chambers 130, 132, 138, 139. Thus, each chamber 130, 132, 138, 139 is isolated from the other chambers 130, 132, 138, 139 in column 120.

Chambers 138, 139 are filled with a gas 106 and sealed from the surrounding environment (e.g., water 101), and thus, provide buoyancy to column 120 during offshore transport and installation of hull 110, as well as during operation of tower 100. Accordingly, chambers 138, 139 may also be referred to as buoyant chambers. In this embodiment, gas 106 is air, and thus, may also be referred to as air 106. As will be described in more detail below, during offshore transport of hull 110, fixed ballast chamber 130 and variable ballast chamber 132 are also filled with air 106, thereby contributing to the buoyancy of column 120. However, during installation of hull 110, chamber 130 is filled with fixed ballast 107 (e.g., water, iron ore, etc.) to increase the weight of column 120, orient column 120 upright, and to drive anchor 140 into the sea floor 102. During offshore drilling and/or production operations with tower 100, the fixed ballast 107 in chamber 130 is generally permanent (i.e., remains in place). During installation of hull 110 at the offshore operation site, variable ballast 108 is controllably added to ballast adjustable chamber 132 to increase the weight of column 120, orient column 120 upright, and to drive anchor 140 into the sea floor 102. However, unlike fixed ballast chamber 130, during offshore drilling and/or production operations with tower 100, ballast 108 in chamber 130 may be controllably varied (i.e., increased or decreased), as desired, to vary the buoyancy of column 120 and hull 110. Two buoyant chambers 138, 139 are included in column 120 to provide redundancy and buoyancy in the event there is damage or a breach of one buoyant chamber 138, 139, uncontrolled flooding of ballast adjustable chamber 132, or combinations thereof. In this embodiment, variable ballast 108 is water 101, and thus, ballast 108 may also be referred to as water 108.

As best shown in FIG. 2, when tower 100 is installed offshore, each chamber 130, 132, 138 is disposed below the sea surface 103, and chamber 139 extends through the sea surface 103 to topside 150. Although column 120 includes four chambers 130, 132, 138, 139 in this embodiment, in general, each column (e.g., each column 120) may include any suitable number of chambers. Preferably, at least one chamber is a ballast adjustable chamber and one chamber is an empty buoyant chamber (i.e., filled with air). Although end caps 123 and bulkheads 124 are described as providing fluid tight seals at the ends of chambers 130, 132, 138, 139, it should be appreciated that one or more end caps 123 and/or bulkheads 124 may include a closeable and sealable access port (e.g., man hole cover) that allows controlled access to one or more chambers 130, 132, 138, 139 for maintenance, repair, and/or service.

Referring still to FIG. 2, tower 100 has a center of buoyancy 105 and a center of gravity 109. Due to the location of fixed ballast in chambers 130 at lower ends 120*b* and variable ballast in the lower portion of chambers 132 adjacent chambers 130, and the air in buoyancy chambers 138, 139 proximal upper ends 120*a* and air in the upper portion of chambers 132 adjacent chambers 138, 139, center of buoyancy 105 is positioned axially above center of gravity 109 during offshore operations (i.e., once installed). As will be described in more detail below, this arrangement offers the potential to enhance the stability of tower 100 when it is in a generally vertical, upright position.

Figure 4:
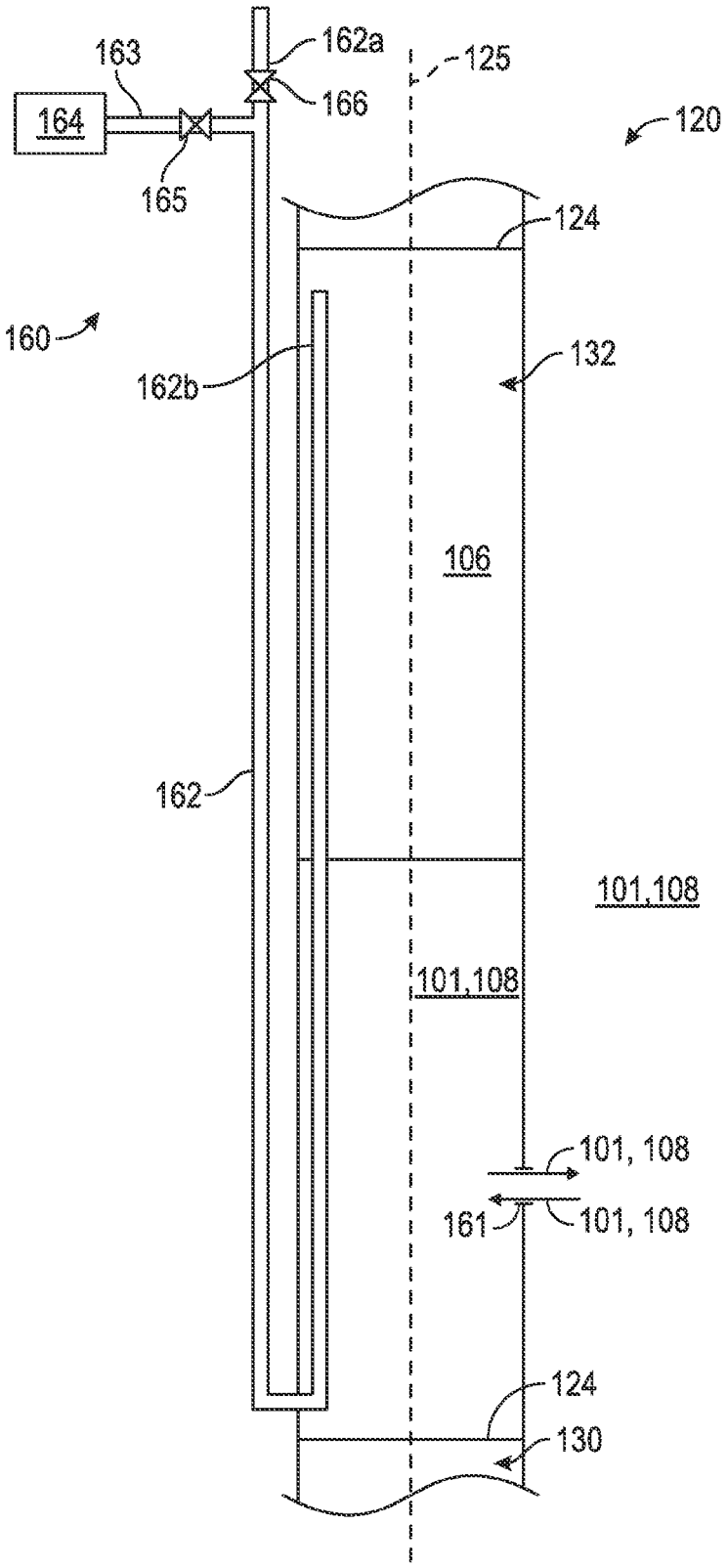
FIG. 4 is an enlarged schematic view of the ballast adjustable chamber of FIG. 2.

Referring now to FIG. 4, one ballast adjustable chamber 132 is schematically shown, it being understood that each ballast adjustable chamber 132 of hull 110 is configured the same. Unlike sealed buoyant chambers 138, 139 previously described, chamber 132 is ballast adjustable. In this embodiment, a ballast control system 160 and a port 161 enable adjustment of the volume of variable ballast 108 in chamber 132. More specifically, port 161 is an opening or hole in tubular 122 axially disposed between the upper and lower axial ends of chamber 132. As previously described, when tower 100 is installed offshore, chamber 132 is submerged in the water 101, and thus, port 161 allows water 101, 108 to move into and out of chamber 132. It should be appreciated that flow through port 161 is not controlled by a valve or other flow control device. Thus, port 161 permits the free flow of water 101, 108 into and out of chamber 132.

Ballast control system 160 includes an air conduit 162, an air supply line 163, an air compressor or pump 164 connected to supply line 163, a first valve 165 along line 163 and a second valve 166 along conduit 162. Conduit 162 extends subsea into chamber 132, and has a venting end 162*a* above the sea surface 103 external chamber 132 and an open end 162*b* disposed within chamber 132. Valve 166 controls the flow of air 106 through conduit 162 between ends 162*a, b*, and valve 165 controls the flow of air 106 from compressor 164 to chamber 132. Control system 160 allows the relative volumes of air 106 and water 101, 108 in chamber 132 to be controlled and varied, thereby enabling the buoyancy of chamber 132 and associated column 120 to be controlled and varied. In particular, with valve 166 open and valve 165 closed, air 106 is exhausted from chamber 132, and with valve 165 open and valve 166 closed, air 106 is pumped from compressor 164 into chamber 132. Thus, end 162*a* functions as an air outlet, whereas end 162*b* functions as both an air inlet and outlet. With valve 165 closed, air 106 cannot be pumped into chamber 132, and with valves 165, 166 closed, air 106 cannot be exhausted from chamber 132.

In this embodiment, open end 162*b* is disposed proximal the upper end of chamber 132 and port 161 is positioned proximal the lower end of chamber 132. This positioning of open end 162*b* enables air 106 to be exhausted from chamber 132 when column is in a generally vertical, upright position (e.g., following installation). In particular, since buoyancy control air 106 (e.g., air) is less dense than water 101, any buoyancy control air 106 in chamber 132 will naturally rise to the upper portion of chamber 132 above any water 101, 108 in chamber 132 when column 120 is upright. Accordingly, positioning end 162*b* at or proximal the upper end of chamber 132 allows direct access to any air 106 therein. Further, since water 101, 108 in chamber 132 will be disposed below any air 106 therein, positioning port 161 proximal the lower end of chamber 132 allows ingress and egress of water 101, 108, while limiting and/or preventing the loss of any air 106 through port 161. In general, air 106 will only exit chamber 132 through port 161 when chamber 132 is filled with air 106 from the upper end of chamber 132 to port 161. Positioning of port 161 proximal the lower end of chamber 132 also enables a sufficient volume of air 106 to be pumped into chamber 132. In particular, as the volume of air 106 in chamber 132 is increased, the interface between water 101, 108 and the air 106 will move downward within chamber 132 as the increased volume of air 106 in chamber 132 displaces water 101, 108 in chamber 132, which is allowed to exit chamber through port 161. However, once the interface of water 101, 108 and the air 106 reaches port 161, the volume of air 106 in chamber 132 cannot be increased further as any additional air 106 will simply exit chamber 132 through port 161. Thus, the closer port 161 to the lower end of chamber 132, the greater the volume of air 106 that can be pumped into chamber 132, and the further port 161 from the lower end of chamber 132, the lesser the volume of air 106 that can be pumped into chamber 132. Thus, the axial position of port 161 along chamber 132 is preferably selected to enable the maximum desired buoyancy for chamber 132.

In this embodiment, conduit 162 extends through tubular 122. However, in general, the conduit (e.g., conduit 162) and the port (e.g., port 161) may extend through other portions of the column (e.g., column 120). For example, the conduit may extend axially through the column (e.g., through cap 123 at upper end 120*a* and bulkheads 124) in route to the ballast adjustable chamber (e.g., chamber 132). Any passages (e.g., ports, etc.) extending through a bulkhead or cap are preferably completely sealed.

Without being limited by this or any particular theory, the flow of water 101, 108 through port 161 will depend on the depth of chamber 132 and associated hydrostatic pressure of water 101 at that depth, and the pressure of air 106 in chamber 132 (if any). If the pressure of air 106 is less than the pressure of water 101, 108 in chamber 132, then the air 106 will be compressed and additional water 101, 108 will flow into chamber 132 through port 161. However, if the pressure of air 106 in chamber 132 is greater than the pressure of water 101, 108 in chamber 132, then the air 106 will expand and push water 101, 108 out of chamber 132 through port 161. Thus, air 106 within chamber 132 will compress and expand based on any pressure differential between the air 106 and water 101, 108 in chamber 132.

In this embodiment, conduit 162 has been described as supplying air 106 to chamber 132 and venting air 106 from chamber 132. However, if conduit 162 is exclusively filled with air 106 at all times, a subsea crack or puncture in conduit 162 may result in the compressed air 106 in chamber 132 uncontrollably venting through the crack or puncture in conduit 162, thereby decreasing the buoyancy of column 120 and potentially impacting the overall stability of structure 100. Consequently, when air 106 is not intentionally being pumped into chamber 132 or vented from chamber 132 through valve 166 and end 162*b*, conduit 162 may be filled with water up to end 162*b*. Such a column of water in conduit 162 is pressure balanced with the compressed air 106 in chamber 132. Without being limited by this or any particular theory, the hydrostatic pressure of the column of water in conduit 162 will be the same or substantially the same as the hydrostatic pressure of water 101, 108 at port 161 and in chamber 132. As previously described, the hydrostatic pressure of water 101, 108 in chamber 132 is balanced by the pressure of air 106 in chamber 132. Thus, the hydrostatic pressure of the column of water in conduit 162 is also balanced by the pressure of air 106 in chamber 132. If the pressure of air 106 in chamber 132 is less than the hydrostatic pressure of the water in conduit 162, and hence, less than the hydrostatic pressure of water 101 at port 161, then the air 106 will be compressed, the height of the column of water in conduit 162 lengthen, and water 101 will flow into chamber 132 through port 161. However, if the pressure of air 106 in chamber 132 is greater than the hydrostatic pressure of the water in conduit 162, and hence, greater than the hydrostatic pressure of water 101 at port 161, then the air 106 will expand and push water 101, 108 out of chamber 132 through port 161 and push the column of water in conduit 162 upward. Thus, when water is in conduit 162, it functions similar to a U-tube manometer. In addition, the hydrostatic pressure of the column of water in conduit 162 is the same or substantially the same as the water 101 surrounding conduit 162 at a given depth. Thus, a crack or puncture in conduit 162 placing the water within conduit 162 in fluid communication with water 101 outside conduit 162 will not result in a net influx or outflux of water within conduit 162, and thus, will not upset the height of the column of water in conduit 162. Since the height of the water column in conduit 162 will remain the same, even in the event of a subsea crack or puncture in conduit 162, the balance of the hydrostatic pressure of the water column in conduit 162 with the air 106 in chamber 132 is maintained, thereby restricting and/or preventing the air 106 in chamber 132 from venting through conduit 162. To remove the water from conduit 162 to controllably supply air 106 to chamber 132 or vent air 106 from chamber 132 via conduit 162, the water in conduit 162 may simply be blown out into chamber 132 by pumping air 106 down conduit 162 via pump 164, or alternatively, a water pump may be used to pump the water out of conduit 162.

Referring again to FIG. 3, fixed ballast chamber 130 is disposed at lower end 120*b* of column 120. In this embodiment, fixed ballast 107 (e.g., water, iron ore, etc.) is pumped into chamber 130 with a ballast pump 133 and a ballast supply flowline or conduit 134 extending subsea to chamber 130. A valve 135 disposed along conduit 134 is opened to pump fixed ballast 107 into chamber 130. Otherwise, valve 135 is closed (e.g., prior to and after filling chamber 130 with fixed ballast 107). In other embodiments, the fixed ballast chamber (e.g., chamber 130) may simply include a port that allows water (e.g., water 101) to flood the fixed ballast chamber once it is submerged subsea.

Although ballast adjustable chamber 132 and fixed ballast chamber 130 are distinct and separate chambers in column 120 in this embodiment, in other embodiments, a separate fixed ballast chamber (e.g., chamber 130) may not be included. In such embodiments, the fixed ballast (e.g., fixed ballast 107) may simply be disposed in the lower end of the ballast adjustable chamber (e.g., chamber 132). The ballast control system (e.g., system 160) may be used to supply air (air 106), vent air, and supply fixed ballast (e.g., iron ore pellets or granules) to the ballast adjustable chamber, or alternatively, a separate system may be used to supply the fixed ballast to the ballast adjustable chamber. It should be appreciated that the higher density fixed ballast will settle out and remain in the bottom of the ballast adjustable chamber, while water and air are moved into and out of the ballast adjustable chamber during ballasting and deballasting operations.

Figure 5:
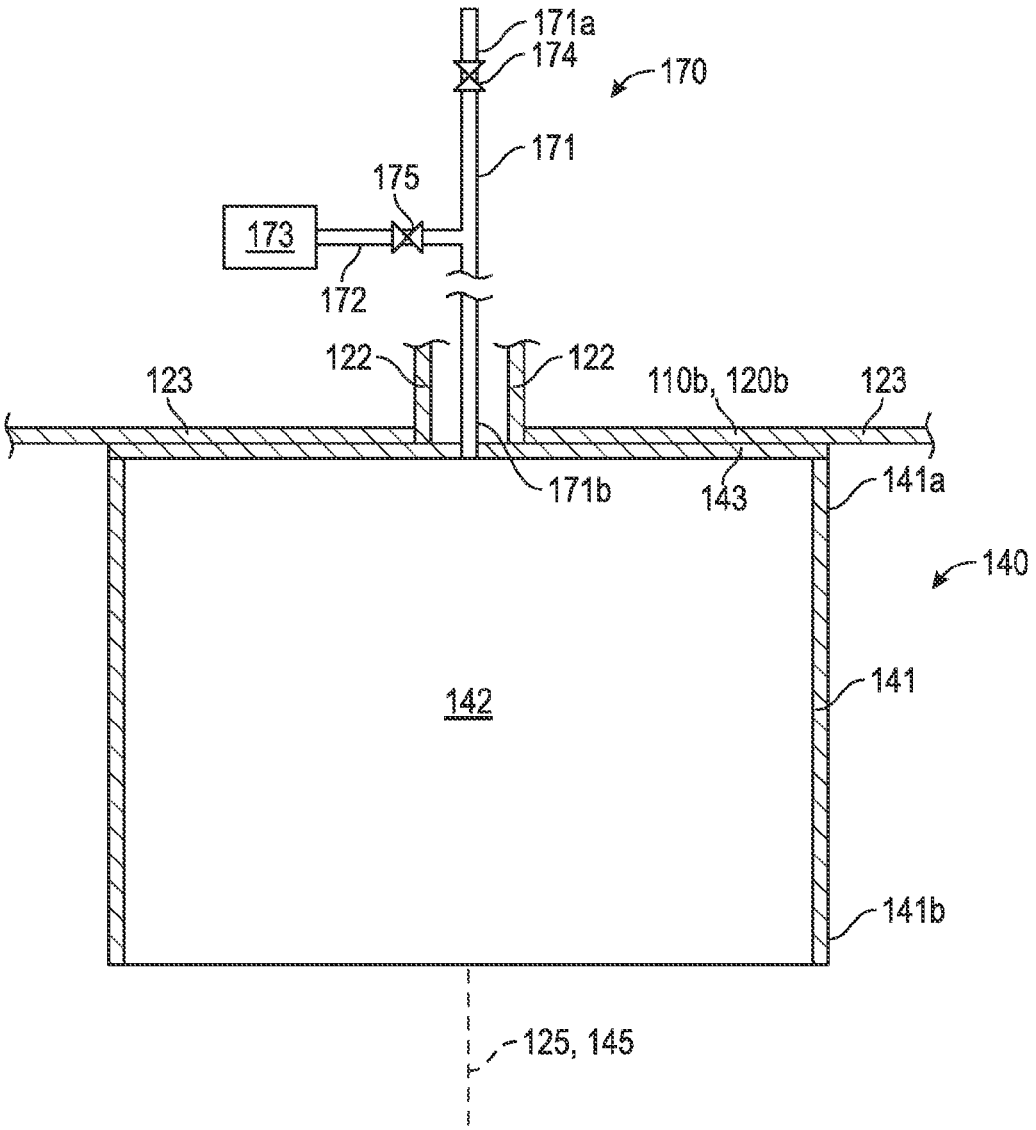
FIG. 5 is an enlarged cross-sectional view of the anchor of FIG. 2.

Referring now to FIG. 5, anchor 140 extends axially from lower end 120*b* of column 120. In this embodiment, anchor 140 is a suction pile comprising an annular, cylindrical skirt 141 having a central axis 145 coaxially aligned with axis 125, a first or upper end 141*a* secured to lower end 110*b* of hull 110, a second or lower end 141*b* distal hull 110, and a cylindrical cavity 142 extending axially between ends 141*a, b*. Cavity 142 is closed off at upper end 141*a* by a cap 143, however, cavity 142 is completely open to the surrounding environment at lower end 141*a*.

As will be described in more detail below, anchor 140 is employed to secure hull 110, and hence tower 100, to the sea floor 102. During installation of hull 110, skirt 141 is urged axially downward into the sea floor 102, and during removal of hull 110 from the sea floor 102 for transport to a different offshore location, skirt 141 is pulled axially upward from the sea floor 102. To facilitate the insertion and removal of anchor 140 into and from the sea floor 102, this embodiment includes a suction/injection control system 170.

Referring still to FIG. 5, system 170 includes a main flowline or conduit 171, a fluid supply/suction line 172 extending from main conduit 171, and an injection/suction pump 173 connected to line 172. Conduit 171 extends subsea to cavity 142, and has an upper venting end 171*a* and a lower open end 171*b* in fluid communication with cavity 142. A valve 174 is disposed along conduit 171 controls the flow of fluid (e.g., mud, water, etc.) through conduit 171 between ends 171*a,b*—when valve 174 is open, fluid is free to flow through conduit 171 from cavity 142 to venting end 171*a*, and when valve 174 is closed, fluid is restricted and/or prevented from flowing through conduit 171 from cavity 142 to venting end 171*a*.

Pump 173 is configured to pump fluid (e.g., water 101) into cavity 142 and pump fluid (e.g., water 101, mud, silt, etc.) from cavity 142 via line 172 and conduit 171. A valve 175 is disposed along line 172 and controls the flow of fluid through line 172—when valve 175 is open, pump 173 may pump fluid into cavity 142 via line 172 and conduit 171, or pump fluid from cavity 142 via conduit 171 and line 172; and when valve 175 is closed, fluid communication between pump 173 and cavity 142 is restricted and/or prevented.

In this embodiment, pump 173, line 172, and valves 174, 175 are positioned axially above hull 110 and may be accessed from topside 150. Further, in this embodiment, conduit 171 extends axially between columns 120. In other words, conduit 171 is disposed within hull 110 and positioned in the space between columns 120. However, in general, the injection/suction pump (e.g., pump 173), the suction/supply line (e.g., line 172), and valves (e.g., valves 174, 175) may be disposed at any suitable location. For example, the pump and valves may be disposed subsea and remotely actuated.

Figure 6:
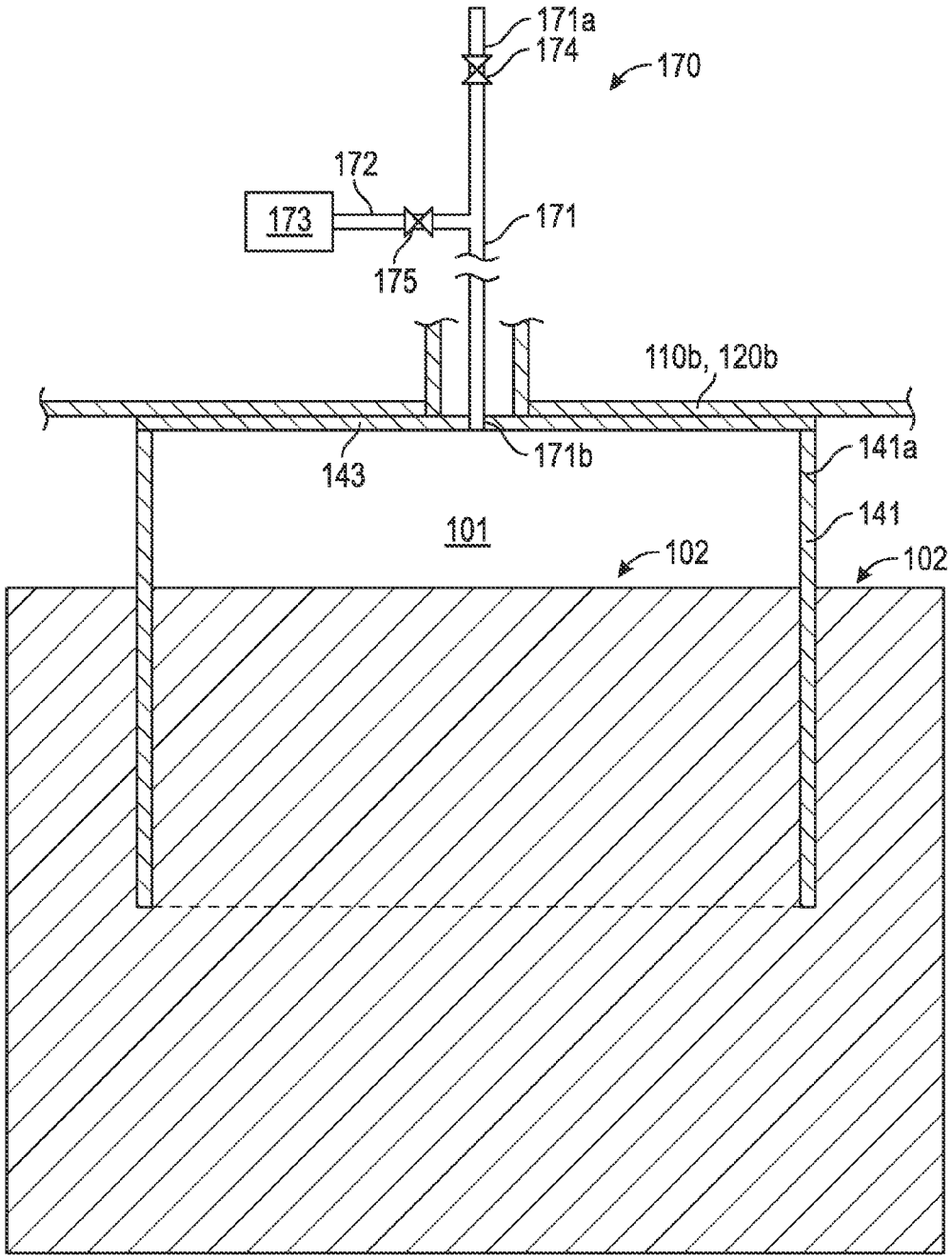
FIG. 6 is an enlarged cross-sectional view of the anchor of FIG. 2 partially penetrating the sea floor during installation or removal of the anchor.

Referring now to FIG. 6, suction/injection control system 170 may be employed to facilitate the insertion and removal of anchor 140 into and from the sea floor 102. In particular, as skirt 141 is urged into sea floor 102, valve 174 may be opened and valve 175 closed to allow water 101 within cavity 142 between sea floor 102 and cap 123 to vent through conduit 171 and out end 171*a*. To accelerate the penetration of skirt 141 into sea floor 102 and/or to enhance the "grip" between suction skirt 141 and the sea floor 102, suction may be applied to cavity 142 via pump 173, conduit 171 and line 172. In particular, valve 175 may be opened and valve 174 closed to allow pump 173 to pull fluid (e.g., water, mud, silt, etc.) from cavity 142 through conduit 171 and line 172. Once skirt 141 has penetrated the sea floor 102 to the desired depth, valves 174, 175 are preferably closed to maintain the positive engagement and suction between anchor 140 and the sea floor 102.

To pull and remove anchor 140 from the sea floor 102 (e.g., to move tower 100 to a different location), valve 174 may be opened and valve 175 closed to vent cavity 142 and reduce the hydraulic lock between skirt 141 and the sea floor 102. To accelerate the removal of skirt 141 from sea floor 102, fluid may be pumped into cavity 142 via pump 173, conduit 171 and line 172. In particular, valve 175 may be opened and valve 174 closed to allow pump 173 to inject fluid (e.g., water) into cavity 142 through conduit 171 and line 172.

Referring again to FIGS. 1 and 2, topside 150 is coupled to upper end 110*a* of hull 110. As will be described in more detail below, topside 150 may be transported to the offshore operational site separate from hull 110 and mounted atop hull 110 at the operational site. The various equipment typically used in drilling and/or production operations, such as a derrick, crane, draw works, pumps, compressors, hydrocarbon processing equipment, scrubbers, precipitators and the like are disposed on and supported by topside 150.

Figure 7:
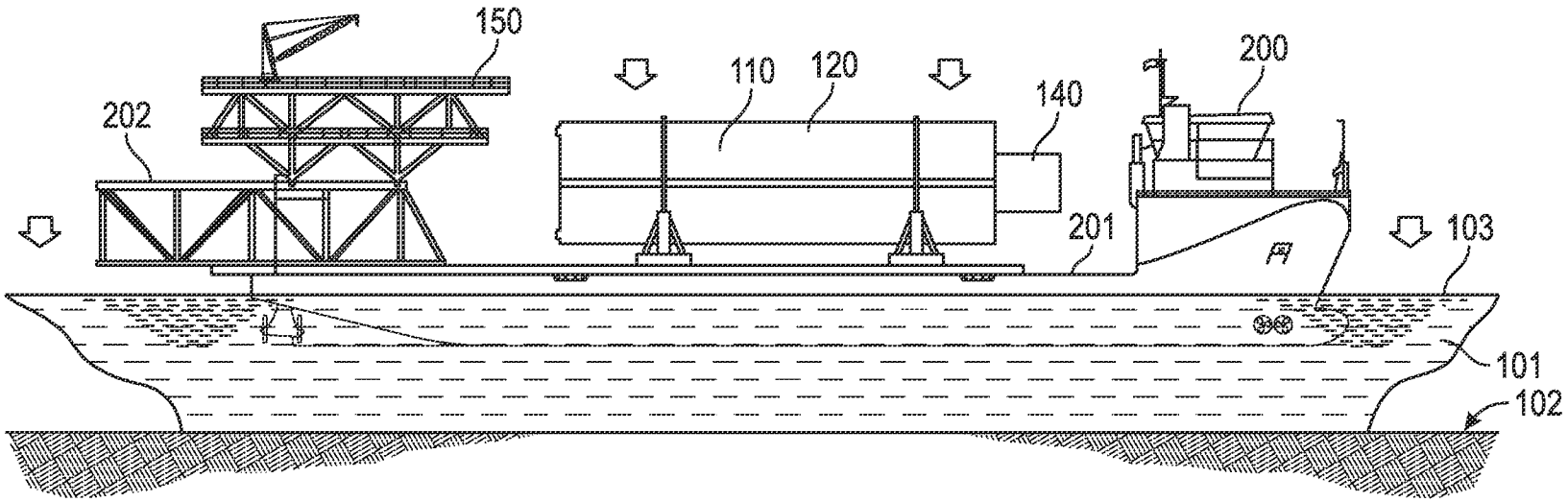
FIGS. 7-18 are schematic sequential views of the offshore deployment, transport, and installation of the tower of FIG. 1.

Referring now to FIGS. 7-15, the offshore deployment and installation of tower 100 is shown. In FIG. 7, hull 110 and topside 150 are shown being transported offshore on a vessel 200; in FIGS. 8-10, hull 110 is shown being offloaded from vessel 110 at an offshore location; in FIGS. 11 and 12, hull 110 is shown being transitioned from a horizontal orientation to an upright orientation at an offshore installation site; in FIGS. 13-15, topside 150 is shown being mounted to hull 110 to form tower 100; and in FIGS. 16-18, tower 100 is shown being anchored to the sea floor 102 with anchor 140.

Referring now to FIG. 7, hull 110 and topside 150 are separately loaded onto the deck 201 of vessel 200 for offshore transport. Hull 110 is loaded onto vessel 200 in a generally horizontal orientation. During loading and offshore transport of hull 110, chambers 130, 132, 138, 139 are completely filled with air 106, and thus, hull 110 is net buoyant.

In general, hull 110 and topside 150 may be loaded onto vessel 200 in any suitable manner. For example, hull 110 and/or topside 150 may be loaded onto vessel 200 with a heavy lift crane. As another example, hull 110 and/or topside 150 may be loaded onto vessel 200 by ballasting vessel 200 such that deck 201 is sufficiently submerged below the sea surface 103, positioning hull 110 and/or topside 150 over deck 201 (e.g., via floatover or use of a pair of barges positioned on either side of vessel 200), and then deballasting vessel 200. As vessel 200 is deballasted, vessel 200 comes into engagement with hull 110 and/or topside 150, and lifts them out of the water 101. In this embodiment, topside 150 is moveably coupled to a pair of parallel offloading rails 202. Once hull 110 and topside 150 are loaded onto vessel 200, they may be transported offshore with vessel 200. Although hull 110 and topside 150 are shown and described as being transported offshore on the same vessel 200 in this embodiment, it should be appreciated that hull 110 and topside 150 may also be transported offshore on separate vessels (e.g., vessels 200). Further, since hull 110 is net buoyant when chambers 130, 132, 138, 139 are completely filled with air 106, hull 110 may also be floated out to the offshore installation site.

Figure 8:
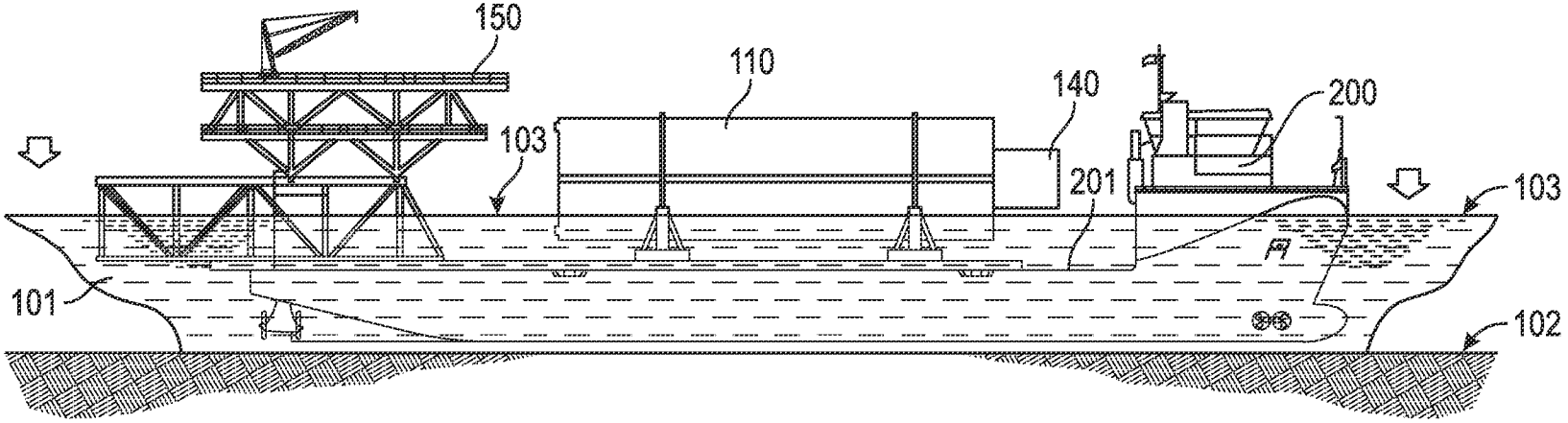
Figure 9:
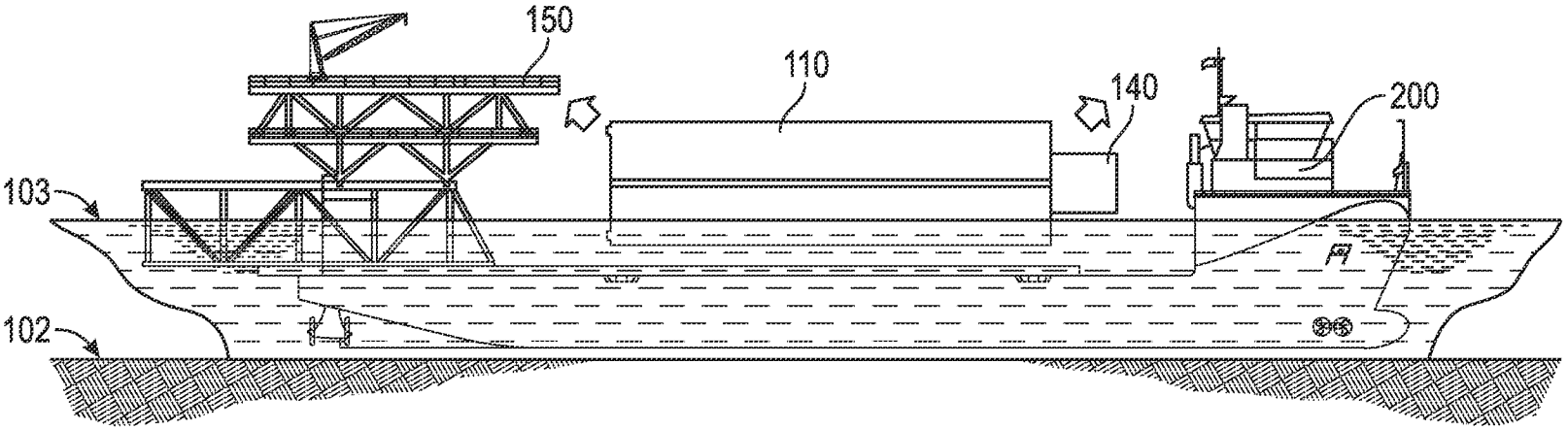
Figure 10:
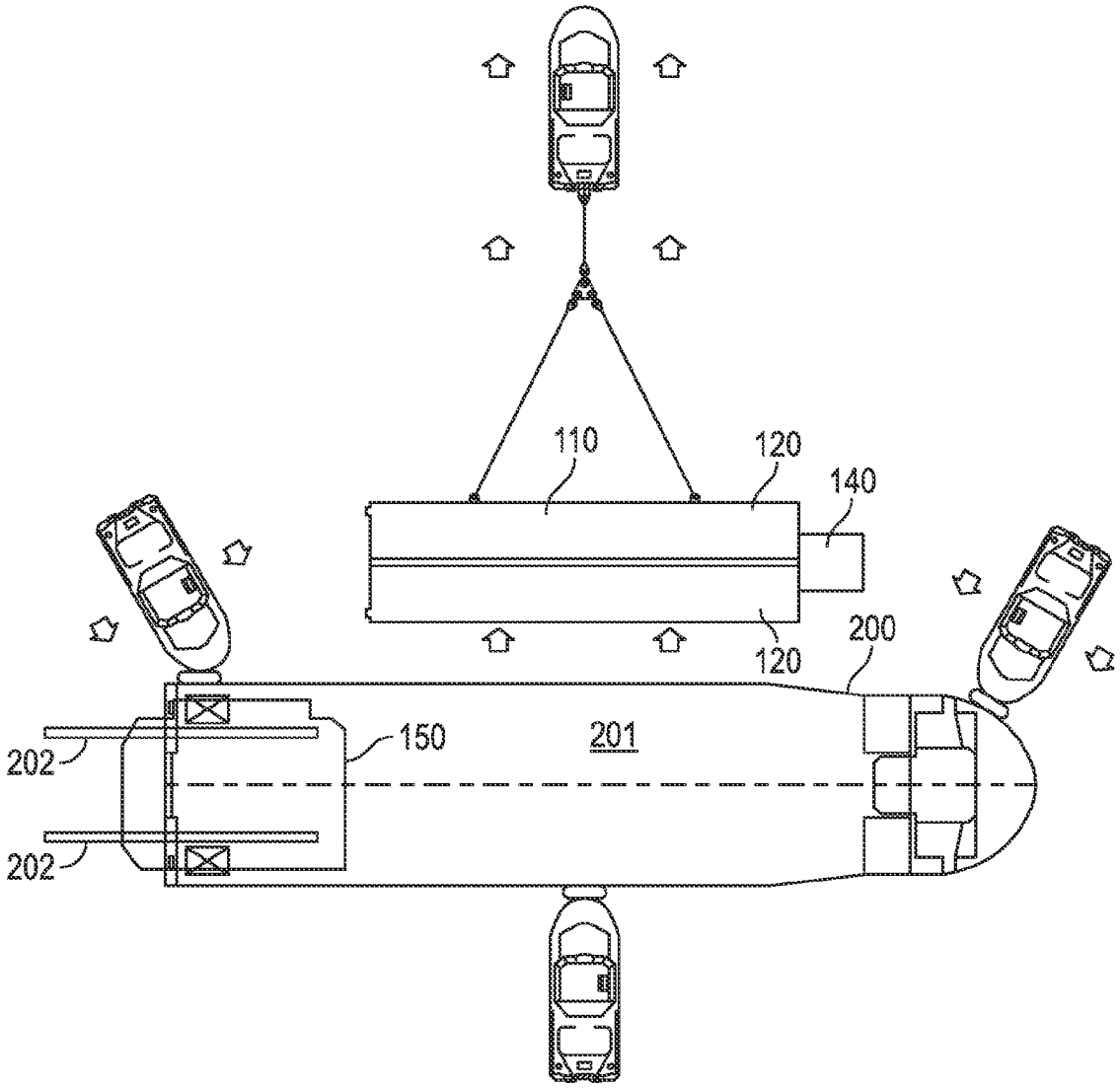

Moving now to FIGS. 8 and 9, at or near the offshore installation site, hull 110 is offloaded from vessel 200. In this embodiment, hull 110 is offloaded by ballasting vessel 200 until deck 201 is disposed sufficiently below the sea surface 103 and buoyant hull 110 floats off and over deck 201. The floating hull 110 is then pulled away from vessel 200 and positioned at the particular installation location in the horizontal orientation as shown in FIG. 10.

Figure 11:
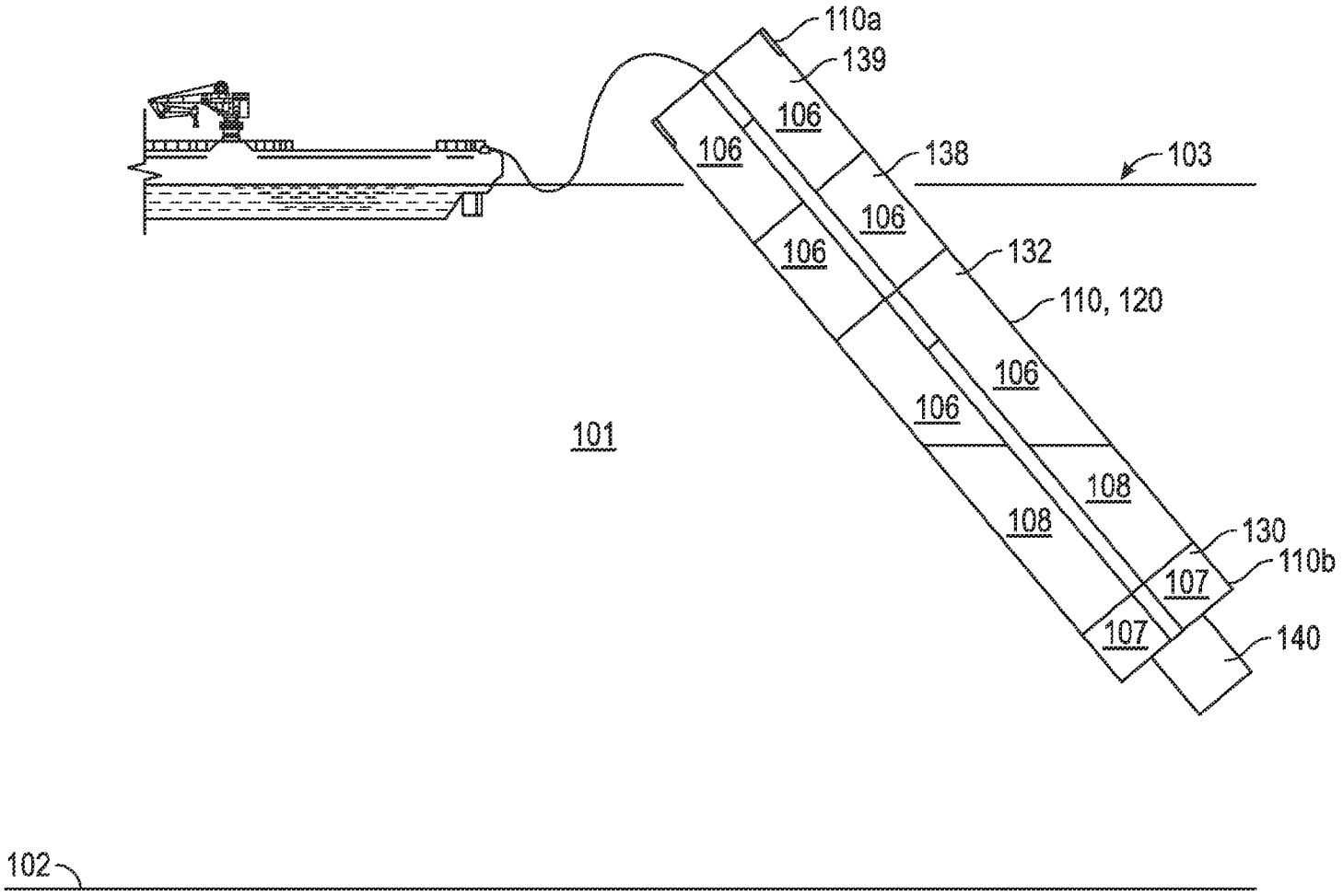
Figure 12:
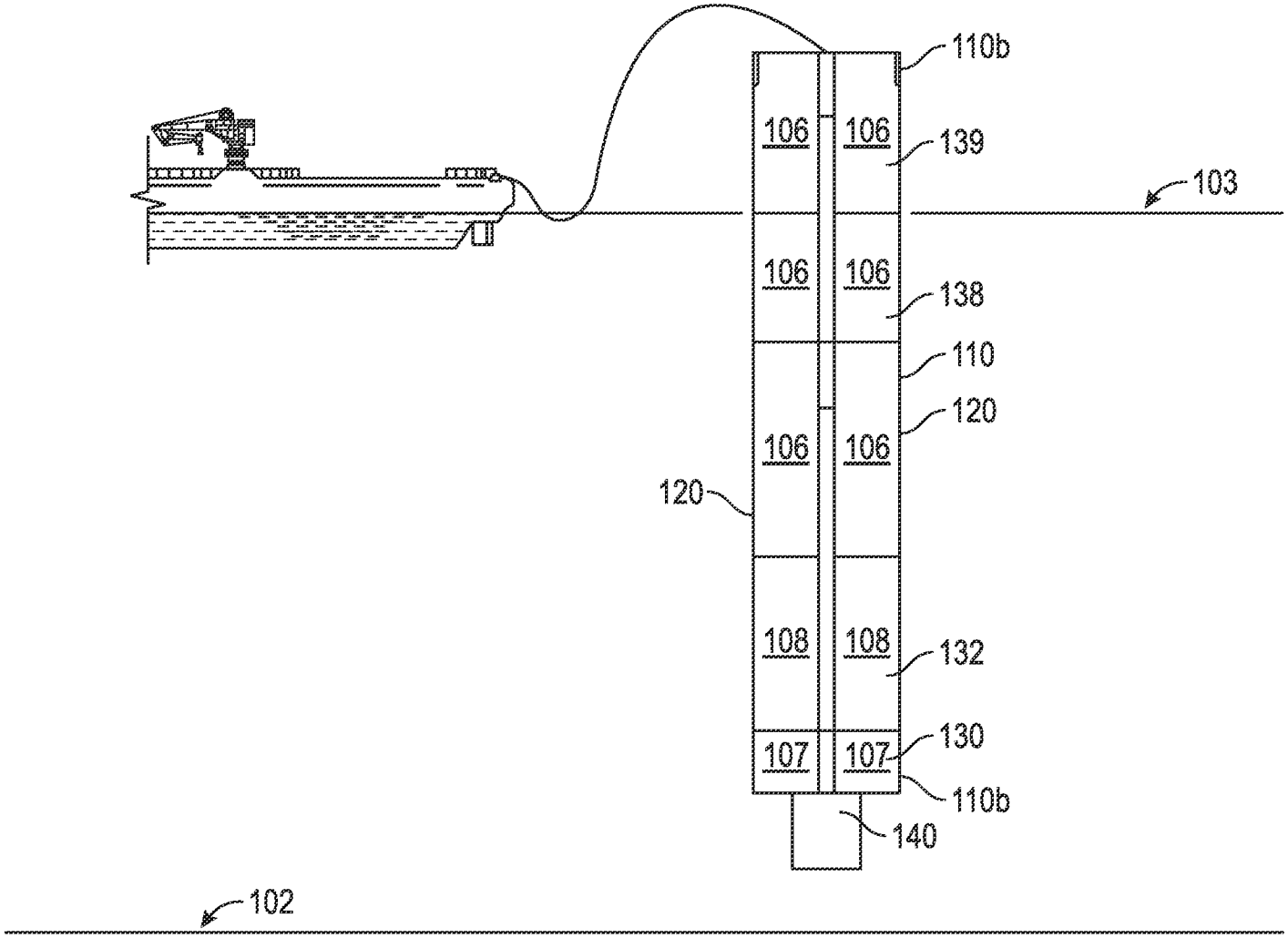

Referring now to FIGS. 11 and 12, hull 110 is transitioned from the floating horizontal orientation to an upright, generally vertical orientation. In particular, chambers 130 are filled with fixed ballast 107 using ballast pumps 133 and associated conduits 134. The fixed ballast 107 may be supplied to pumps 133 from an offshore vessel such as vessel 200. Since buoyant chambers 138, 139 are filled with air, sealed and disposed proximal end 120*a*, as the volume and weight of fixed ballast 107 in each chamber 130 increases, end 110*b* of hull 110 will begin to swing downward. Once ports 161 of variable ballast chambers 132 become submerged below the sea surface 103, chambers 132 will begin to flood with water 101, 108, thereby further facilitating the rotation of hull 110 to the upright position shown in FIG. 12. The degree of flooding of chambers 132 may be enhanced by allowing air 106 in chambers 132 to vent through conduits 162 by opening valves 166. Water 108 may also be pumped into chambers 132 via conduits 162. With hull 110 generally upright, the overall draft of hull 110 may be managed and adjusted using ballast control systems 160 as previously described to vary the relative volumes of air 106 and water 101, 108 in chambers 132.

Figure 13:
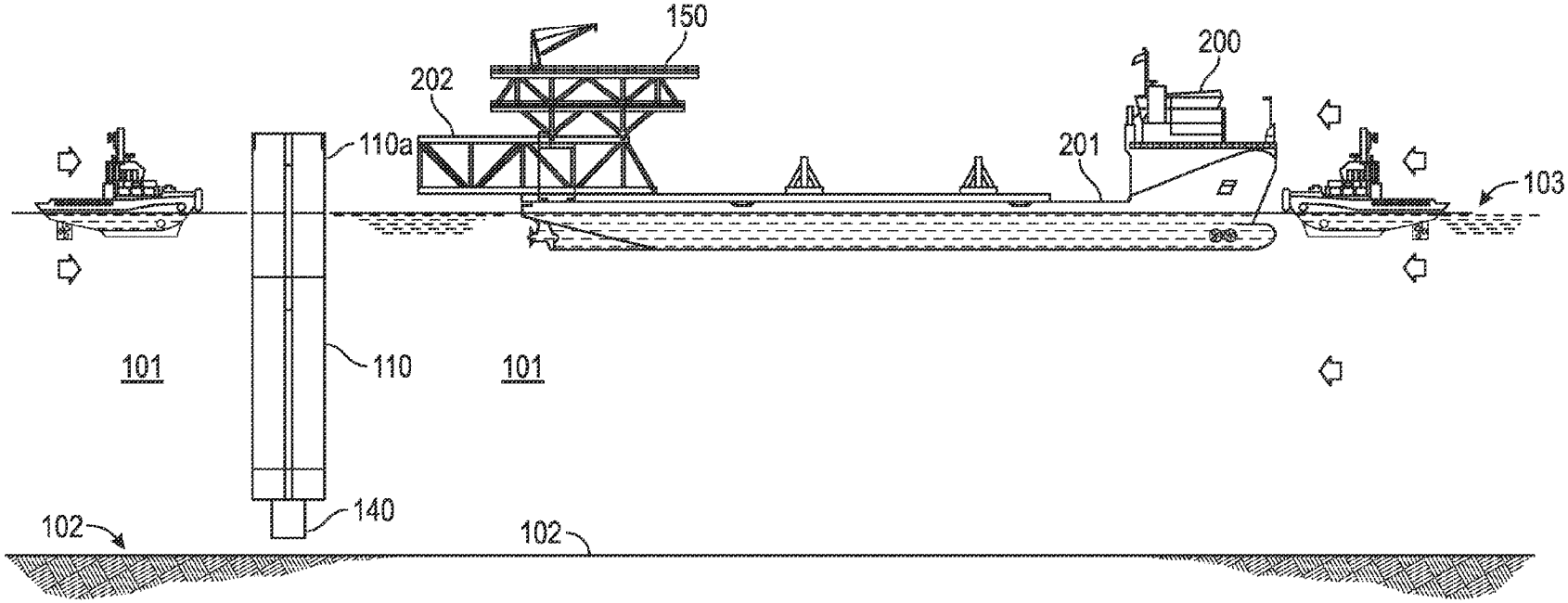
Figure 14:
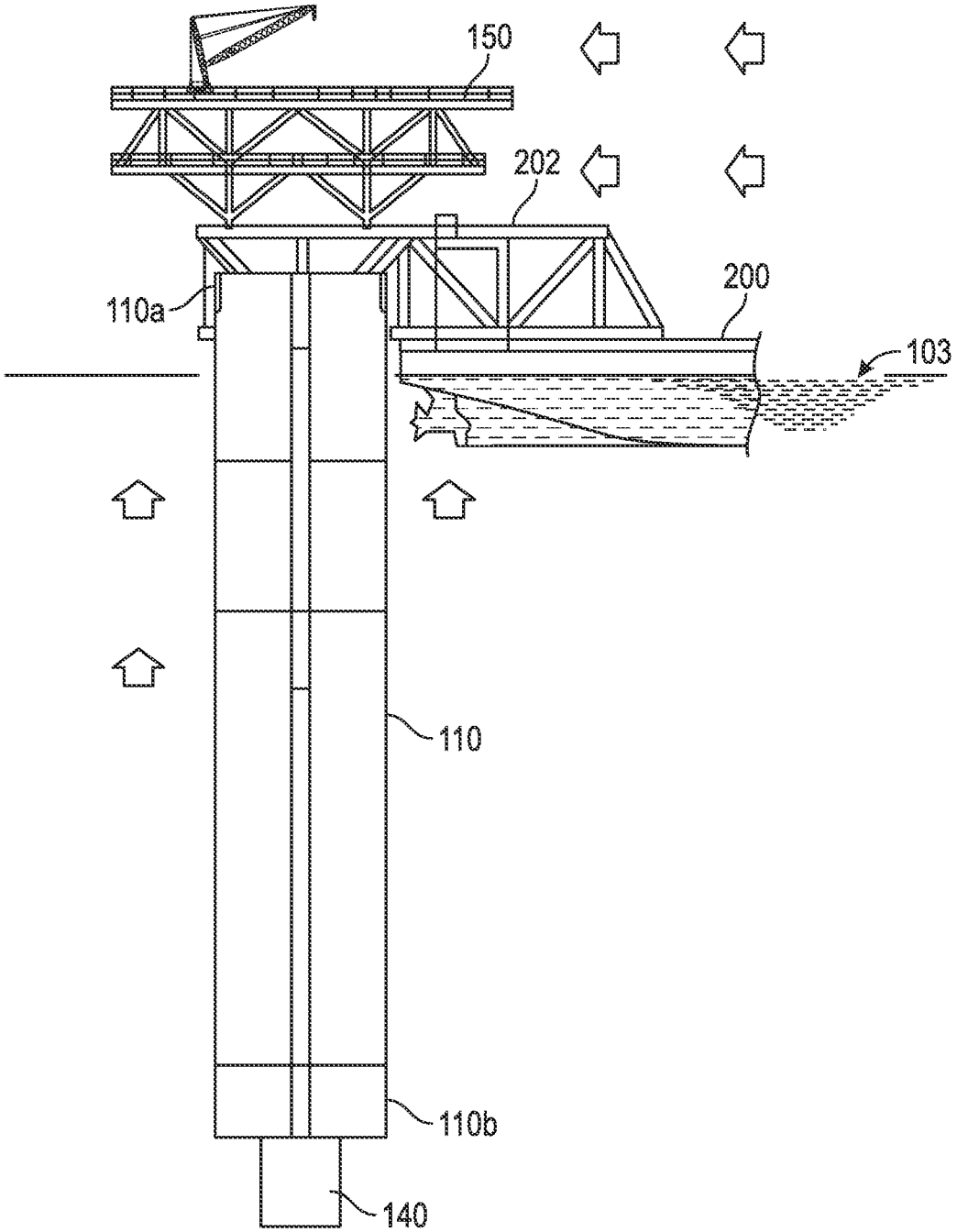
Figure 15:
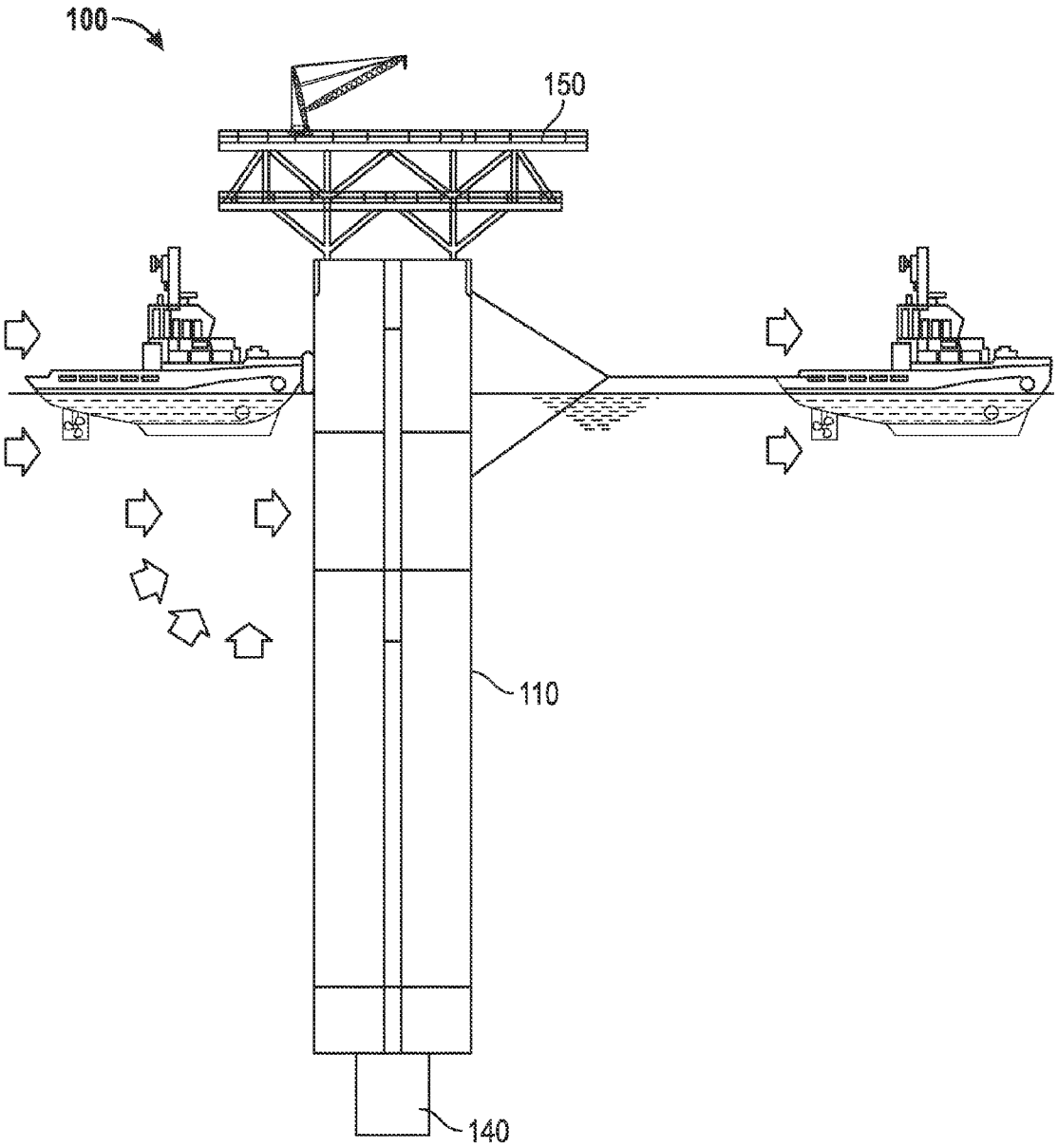

Moving now to FIGS. 13 and 14, topside 150 is mounted to hull 110 once it is generally upright and vertical. As shown in FIG. 13, vessel 200 is deballasted and/or hull 110 is ballasted to raise the position of topside 150 relative to upper end 110*a* of hull 110. Hull 110 may be ballasted by simply venting air 106 from chambers 132 and allowing water 101, 108 to flow into chambers 132 via ports 161. Next, as shown in FIG. 14, vessel 200 and/or hull 110 are maneuvered to position rails 202 on opposite sides of hull 110, and topside 150 is advanced along rails 202 until it is positioned immediately over hull 110. With topside 150 sufficiently positioned over upper end 110*a*, hull 110 is deballasted and/or vessel 200 is ballasted such that hull 110 moves upward relative to topside 150, engages topside 150, and lifts topside 150 from rails 202, thereby mating topside 150 to hull 110 and forming tower 100. Hull 110 is deballasted by increasing the volume of air 106 and decreasing the volume of water 101, 108 in chambers 132. At this point, tower 100 is net buoyant and may be laterally adjusted or moved to position it over the specific installation site as shown in FIG. 15. Although topside 150 is shown being mounted to upper end 110*a* of hull 110 via rails 202 in FIGS. 13 and 14, in other embodiments, topside 150 may be mounted to hull 110 using other suitable means. For example, topside 150 may be supported by two spaced barges, hull 110 ballasted, topside 150 maneuvered by the barges over hull 110 with the barges disposed on either side of hull 110, and then hull 110 deballasted to lift topside 150 from the barges.

Figure 16:
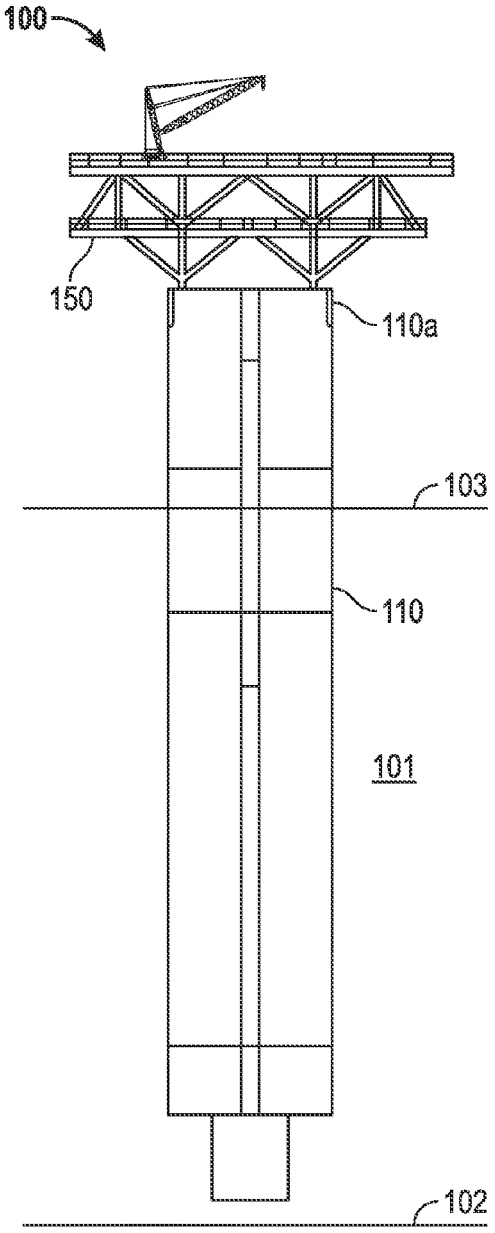
Figure 17:
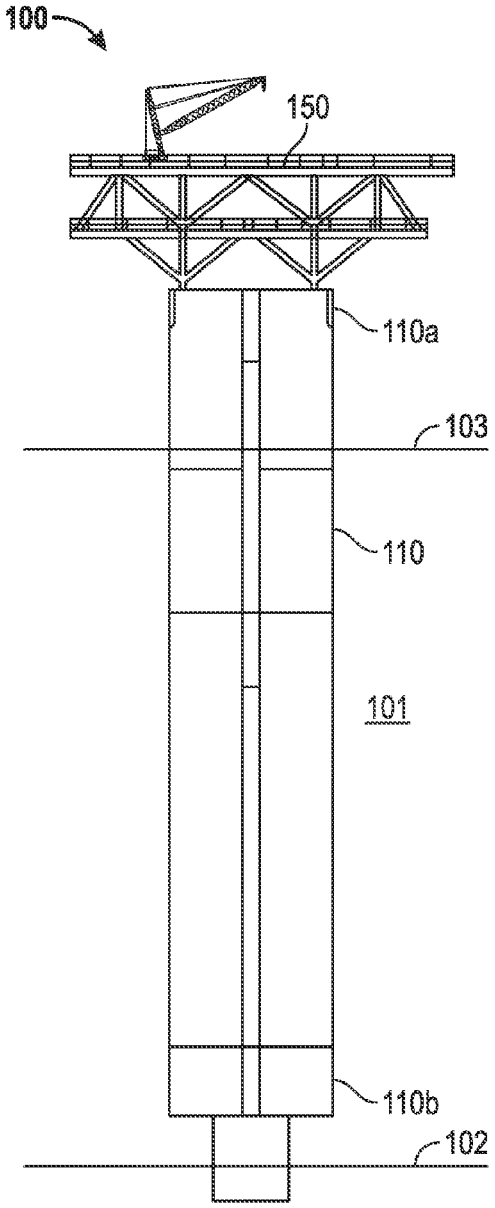
Figure 18:
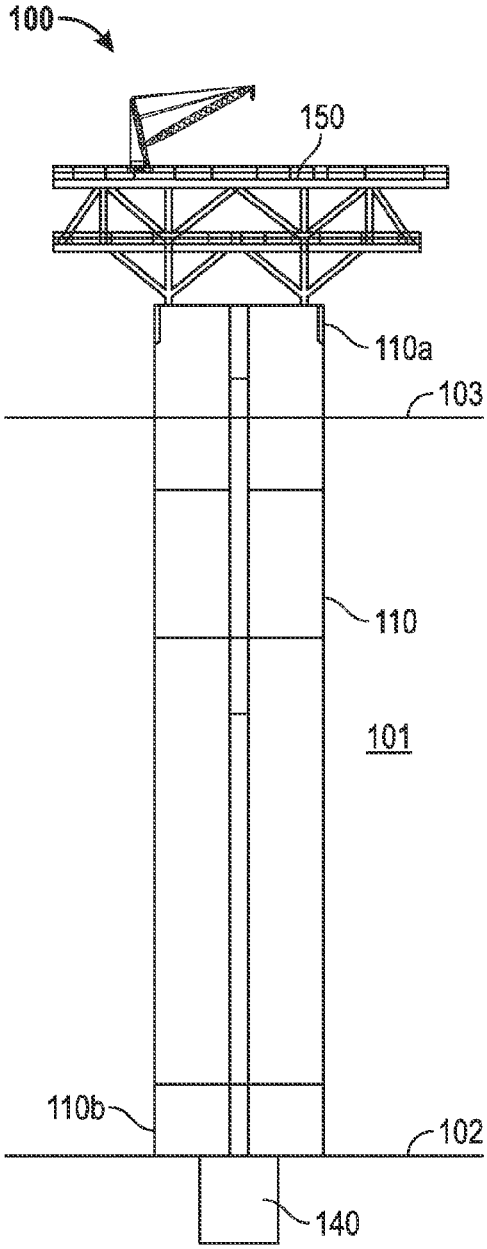

Referring now to FIGS. 16-18, at the installation site, hull 110 is ballasted to lower tower 100 into engagement with the sea floor 102 and push skirt 141 into the sea floor 102. Systems 170 may be employed to apply suction to cavity 142 and facilitate the penetration of skirt 141 into the sea floor 102. With anchor 140 sufficiently embedded in the sea floor 102, the overall weight and buoyancy of tower 100 is adjusted as desired, by controlling the relative volumes of air 106 and water 101, 108 in chambers 132. In embodiments described herein, the relative volumes of air 106 and water 101, 108 in chambers are preferably controlled such that the downward loads on anchor 140 are minimized while being sufficient to maintain engagement of anchor 140 and the sea floor 102. In particular, the total weight of tower 100 preferably exceeds the total buoyancy of tower 100 by about 250 to 1000 tons, and more preferably about 500 tons to ensure penetration of skirt 141 into sea floor 102 is maintained during subsequent drilling and/or production operations. The total load applied to skirt 141 (i.e., the difference between the total weight and total buoyancy of tower 100) may be varied and controlled as desired by ballasting and deballasting hull 110 using ballast control systems 160 previously described.

Figure 19:
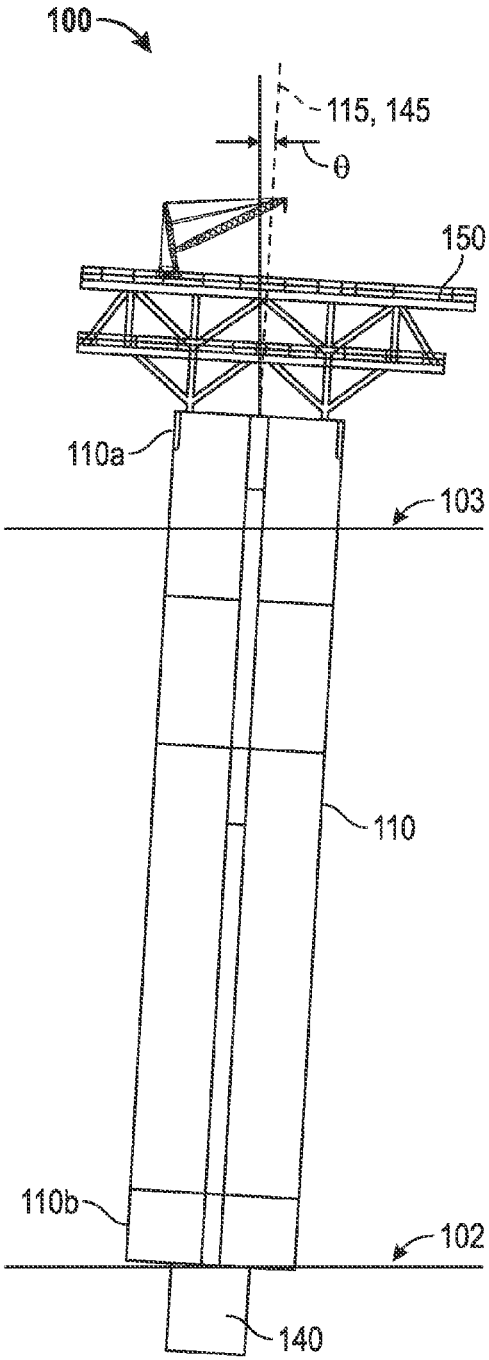
FIG. 19 is a front view of the tower of FIG. 1 secured to the sea floor and pivoting relative to the sea floor.

As best shown in FIG. 19, the relatively small net downward force in combination with the center of buoyancy 105 being positioned above the center of gravity 109, allows tower 100 to pivot or pitch from vertical relative to the sea floor 102 in response to environmental loads (e.g., wind, waves, currents, earthquakes, etc.). In FIG. 19, tower 100 is shown oriented at a pitch angle θ measured from vertical. The relationship between the position of center of gravity 109 and center of buoyancy 105 determines the pitch stiffness and maximum pitch angle θ of tower 100. In general, pitch stiffness and maximum pitch angle θ are inversely related. Thus, as pitch stiffness increases (i.e., resistance to pitch increases), the maximum pitch angle θ decreases; and as pitch stiffness decreases, the maximum pitch angle θ increase. The pitch stiffness and maximum pitch angle θ can be varied and controlled by adjusting the relative volumes of air 106 and water 101, 108 in chambers 132 to control the location of center of gravity 109 and center of buoyancy 105. For example, as the volume of water 101, 108 in chambers 132 is increased and the volume of air 106 in chambers 132 is decreased, the center of buoyancy 105 moves upward and center of gravity 109 moves downward; and as the volume of water 101, 108 in chambers 132 is decreased and the volume of air 106 in chambers 132 is increased, the center of buoyancy 105 moves downward and center of gravity 109 moves upward. As center of gravity 109 and center of buoyancy 105 are moved apart (i.e., center of gravity 109 is moved downward and center of buoyancy 105 is moved upward), pitch stiffness increases and maximum pitch angle θ decreases; however, as center of gravity 109 and center of buoyancy 105 are moved toward each other (i.e., center of gravity 109 is moved upward and center of buoyancy 105 is moved downward), pitch stiffness decreases and maximum pitch angle θ increases. Thus, by controlling the relative volumes of air 106 and water 101, 108 in chambers 132, the pitch stiffness and maximum pitch angle θ can be controlled. For embodiments described herein, the maximum pitch angle θ is preferably less or equal to 10°.

As previously described, embodiments of tower 100 described herein have a center of buoyancy 105 positioned above the center of gravity 109, thereby enabling tower 100 to respond to environmental loads and exhibit advantageous stability characteristics similar to floating Spar platforms, which also have a center of buoyancy disposed above their center of gravity. A floating Spar platform pitches about the lower end of its subsea hull, with its lateral position being maintained with a mooring system. Similarly, embodiments of tower 100 are free to pitch about lower end 110*b* of hull 110. However, lower end 110*b* is directly secured to the sea floor 102 with anchor 140, which provides resistance to lateral movement of tower 100. The relatively small vertical loads placed on anchor 140 as previously described (e.g., 250 to 1000 tons) serves to ensure that tower 100 has a sufficient amount of lateral load capacity to withstand environmental loads without disengaging the sea floor 102 or moving laterally. It should be appreciated that is in stark contrast to most conventional offshore structures that are typically placed in pure compression (fixed platforms and compliant towers) or pure tension (tension leg platforms). Accordingly, the dynamic behavior of tower 100 is different than such conventional offshore structures.

As previously described, in embodiments described herein, anchor 140 is subjected to relatively lower vertical loads because tower 100 provides significant buoyancy. In addition, since tower 100 pivots from vertical about lower end 110*b*, anchor 140 serves as a pivoting joint. Suction skirt 141 provides a relatively simple mechanical apparatus designed and operated (e.g., depth of penetration into the sea floor 102 may be adjusted) based on the stiffness of the soil at the sea floor 102. In other words, if the soil at the sea floor 102 has a high stiffness, then skirt 141 may be partially embedded in the sea floor 102, and on the other hand, if the soil at the sea floor 102 has a low stiffness, then skirt 141 may be fully embedded in the sea floor 102. In other words, the depth of penetration of skirt 141 into the sea floor 102 may be dictated by the stiffness of the soil at the sea floor 102 to enable the desired dynamic behavior for tower 100 (e.g., pitch stiffness, maximum pitch angle θ, natural period, etc.). This approach of leveraging some of the inherent compliance of soil at the sea floor to provide pitch compliance for tower 100 offers potential advantages over complex articulating mechanical connections at the sea floor, which may be unreliable and/or a weak point for articulate towers.

Following offshore drilling and/or production operations at a first offshore installation site, tower 100 may be lifted from the sea floor 102, moved to a second installation site, and installed at the second installation site. In general, tower 100 is lifted from the sea floor 102 by reversing the order of the steps taken to install tower 100. Namely, hull 110 is deballasted so that tower 100 is slightly net buoyant. Hull 110 is deballasted by pumping air 106 into chambers 132 and forcing water 101, 108 out of chambers 132 through ports 161. Next, cavities 142 are vented (by opening valves 174) to reduce the hydraulic lock between skirt 141 and the sea floor 102 and allow tower 100 to rise upward and pull anchor 140 from the sea floor 102. Alternatively, a fluid (e.g., water) may be pumped into cavities 142 with injection pumps 173 to urge skirt 141 upward relative to the sea floor 102. Relying on net buoyancy, as well as venting of cavities or injection of fluid into cavities 142, tower 100 rises upward and anchor 140 is pulled from the sea floor. At this point, tower 100 is free floating and may be towed to the second installation location and installed in the same manner as previously described.

In the manner described, embodiments described herein (e.g., tower 100) include a hull (e.g., hull 110) with a plurality of cellular cylindrical columns (e.g., columns 120 comprising distinct and separate chambers 130, 132, 138, 139). Such cellular columns offer the potential to enhance fabrication and installation efficiencies as compared to most conventional jackets for fixed platforms and truss structures for compliant towers, particularly in geographic regions with limited experience and skilled resources. In addition, embodiments described herein offer a number of advantages over fixed jacket platforms from a deployment, installation, and operational perspective. In particular, no derrick barge is required to lift the deck (e.g., deck 150) because the hull (e.g., hull 110) is configured for simple installation of the deck either in the floating condition or once the hull has already been placed on location. Further, no launch barge is required because the hull can float off a transport ship (e.g., vessel 200), and no derrick barge is required to upend the hull because it is self-upending via operation of the ballast control systems.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simply subsequent reference to such steps.

What is claimed is:

1. An offshore structure for drilling and/or producing a subsea well, the structure comprising:

a hull having a longitudinal axis, a first end, and a second end opposite the first end;

an anchor coupled to the second end of the hull and configured to secure the hull to the sea floor, wherein the anchor has an aspect ratio greater than or equal to 1:1 and less than or equal to 2:1;

wherein the hull includes a variable ballast chamber positioned axially between the first end and the second end of the hull and a first buoyant chamber positioned between the variable ballast chamber and the first end of the hull;

wherein the first buoyant chamber is filled with a gas and sealed from the surrounding environment;

a ballast control conduit in fluid communication with the variable ballast chamber and configured to supply a gas to the variable ballast chamber;

a topside mounted to the first end of the hull.

2. The offshore structure of claim 1, wherein the hull includes a first port in fluid communication with the variable ballast chamber, wherein the first port is configured to allow water to flow into and out of the variable ballast chamber from the surrounding environment.

3. The offshore structure of claim 2, wherein the hull includes a fixed ballast chamber axially positioned between the variable ballast chamber and the second end, wherein the fixed ballast chamber is configured to be filled with fixed ballast.

4. The offshore structure of claim 1, wherein the ballast control conduit has an end disposed within the variable ballast chamber.

5. The offshore structure of claim 4, wherein the end of the ballast control conduit is positioned near an upper end of the variable ballast chamber.

6. The offshore structure of claim 1, wherein the anchor is a suction pile including a suction skirt extending axially from the second end of the hull.

7. The offshore structure of claim 6, further comprising a fluid conduit in fluid communication with a cavity within the suction skirt, wherein the fluid conduit is configured to vent the cavity, pump a fluid into the cavity, or draw a fluid from the cavity.

8. The offshore structure of claim 1, further comprising a second buoyant chamber axially positioned between the first buoyant chamber and the variable ballast chamber, wherein the first buoyant chamber is filled with a gas and sealed from the surrounding environment.

9. The offshore structure of claim 1, wherein the hull comprises a plurality of parallel columns, wherein each column has a central axis, a first end, and a second end opposite the first end; and wherein each column includes a variable ballast chamber positioned between the first end and the second end of the column, a buoyancy chamber positioned between the variable ballast chamber of the column and the first end;

means for supply a gas to the variable ballast chamber of each column.

10. The offshore structure of claim 1, wherein the hull has a length measured axially from the first end to the second end, wherein the length of the hull is greater than 300 feet.

11. The offshore structure of claim 10, wherein the anchor has a diameter of 15 feet to 50 feet.

12. A method, comprising:

(a) transporting a hull of a buoyant tower to an offshore installation site on a single vessel having a deck, wherein the hull includes a first end, a second end opposite the first end, and an anchor coupled to the second end;

(b) ballasting the vessel;

(c) floating the hull off the vessel during or after (b);

(d) supporting a topside of the buoyant tower on a pair of rails mounted to the vessel;

(e) maneuvering the hull between the pair of rails;

(f) ballasting the vessel or de-ballasting the hull;

(g) lifting the topside off of the pair of rails during (f);

(h) ballasting the hull;

(i) penetrating the sea floor with the anchor; and (j) allowing the tower to pitch about the lower end of the hull after (i).

13. The method of claim 12, wherein (i) comprises allowing the tower to pitch to a maximum pitch angle relative to vertical that is less than 10°.

14. The method of claim 12, wherein the anchor has an aspect ratio less than 3:1.

15. The method of claim 14, wherein the aspect ratio of the anchor is greater than or equal to 1:1 and less than or equal to 2:1.

16. The method of claim 12, further comprising:

(k) floating the hull at the sea surface in a horizontal orientation;

(l) transitioning the hull from the horizontal orientation to a vertical orientation with the first ends disposed above the second ends; and (m) mounting the topside to the hull above the sea surface to form the buoyant tower.

17. The method of claim 16, wherein the hull includes a variable ballast chamber axially positioned axially between the first end and the second end and a first buoyant chamber positioned between the variable ballast chamber and the first end;

wherein (l) comprises:

flowing variable ballast into the variable ballast chamber.

18. The method of claim 12, wherein the anchor is a suction pile extending axially from the second end of hull;

wherein (i) comprises:

(i1) penetrating the sea floor with the suction skirt; and (i2) pumping a fluid from a cavity within the suction skirt during (i1).

19. The method of claim 18, further comprising:

(k) deballasting the hull after (j); and (l) pulling the anchor from the sea floor.

20. The method of claim 19, wherein (h) comprises increasing a volume of variable ballast in the hull.

21. The method of claim 20, wherein (h) comprises allowing a gas in the hull to vent and allowing water to flow into the hull through a port in the hull.

22. The method of claim 21, wherein (k) comprises decreasing the volume of variable ballast in the hull.

23. The method of claim 22, wherein (k) comprises pumping a gas into the hull and allowing water to flow out of the hull through the port in the hull.

24. The method of claim 19, further comprising:

pumping a fluid into the cavity during (l).

25. The method of claim 12, further comprising maintaining a downward vertical load of 250 to 1000 tons on the anchor during (j).

26. The method of claim 12, wherein (b) comprises submerging the deck of the vessel below the sea surface.

27. The method of claim 12, wherein the tower has a center of buoyancy and a center of gravity that is below the center of buoyancy during (j).

28. The method of claim 12, further comprising maintaining the position of the tower at the offshore installation site during (j) without mooring lines.

* * * * *